US005909924A

United States Patent [19]

Roslund, Jr.

[11] Patent Number: 5,909,924

[45] Date of Patent: Jun. 8, 1999

[54] TILT CONTROL FOR CHAIR

[75] Inventor: Richard N. Roslund, Jr., Georgetown Township, Ottawa County, Mich.

[73] Assignee: Haworth, Inc., Holland, Mich.

[21] Appl. No.: 08/846,618

[22] Filed: Apr. 30, 1997

[51] Int. Cl.[6] ..... A47C 1/024

[52] U.S. Cl. ..... 297/300.4; 297/303.3

[58] Field of Search ..... 297/300.1, 300.4, 297/303.1, 303.3

[56] References Cited

U.S. PATENT DOCUMENTS

| | | | |
|---|---|---|---|
| D. 318,577 | 7/1991 | Chadwick et al. . | |
| 343,626 | 6/1886 | Davis . | |
| D. 344,649 | 3/1994 | Wilcox et al. . | |
| 477,106 | 6/1892 | Davis . | |
| 1,986,105 | 1/1935 | Foote . | |
| 2,056,965 | 10/1936 | Herold . | |
| 2,398,072 | 4/1946 | Boerner . | |
| 2,729,273 | 1/1956 | Hamilton et al. . | |
| 3,072,436 | 1/1963 | Moore . | |
| 3,740,792 | 6/1973 | Werner | 297/303.1 |
| 3,881,772 | 5/1975 | Mohrman . | |
| 4,143,910 | 3/1979 | Geffers et al. . | |
| 4,270,797 | 6/1981 | Bräuning . | |
| 4,314,728 | 2/1982 | Faiks . | |
| 4,390,206 | 6/1983 | Faiks et al. . | |
| 4,438,898 | 3/1984 | Knoblauch et al. . | |
| 4,494,795 | 1/1985 | Roossien et al. . | |
| 4,684,173 | 8/1987 | Locher . | |
| 4,709,962 | 12/1987 | Steinmann . | |
| 4,720,142 | 1/1988 | Holdredge et al. . | |
| 4,776,633 | 10/1988 | Knoblock et al. . | |
| 4,830,431 | 5/1989 | Inoue . | |
| 4,865,384 | 9/1989 | Desanta . | |
| 4,889,384 | 12/1989 | Sulzer . | |
| 4,889,385 | 12/1989 | Chadwick et al. . | |
| 4,892,354 | 1/1990 | Estkowski et al. . | |
| 5,026,117 | 6/1991 | Faiks et al. . | |
| 5,050,931 | 9/1991 | Knoblock . | |
| 5,102,196 | 4/1992 | Kaneda et al. . | |
| 5,106,157 | 4/1992 | Nagelkirk et al. . | |
| 5,192,114 | 3/1993 | Hollington et al. . | |
| 5,318,346 | 6/1994 | Roossien et al. . | |
| 5,328,242 | 7/1994 | Steffens et al. . | |
| 5,333,368 | 8/1994 | Kriener et al. | 297/303.3 |
| 5,370,445 | 12/1994 | Golynsky | 297/303.3 |
| 5,385,388 | 1/1995 | Faiks et al. . | |
| 5,388,889 | 2/1995 | Golynsky | 297/303.3 |

FOREIGN PATENT DOCUMENTS

| | | |
|---|---|---|
| 0176816 | 4/1986 | European Pat. Off. . |
| 4216358 | 11/1992 | Germany . |

OTHER PUBLICATIONS

EVO brochure, American Seating, 1992 (4 pages).

EVO 2 brochure, American Seating, Mar. 31, 1997 (1 page).

*Primary Examiner*—Peter M. Cuomo

*Assistant Examiner*—Anthony D. Barfield

*Attorney, Agent, or Firm*—Flynn, Thiel, Boutell & Tanis, P.C.

[57] ABSTRACT

A tilt control mechanism for an office chair includes a spring arrangement which permits forward and rearward tilting of the chair while also urging the chair to a normal upright position. The spring arrangement includes front and rear springs which act in combination such that the upward acting forces acting on the chair can be varied during use. The forces being applied by the front spring are adjusted by a side-actuated tension adjustment mechanism which incorporates a wedge block for adjusting the spring forces. Further, the rear springs provide a variable spring force such that the spring force is maximized when in the normal position but is decreased substantially once the chair is fully reclined. This reduction in spring force allows a user to maintain the chair in the fully reclined position with significantly less force than was required to tilt the chair rearwardly while a sufficient spring force continues to be applied by the front spring to urge the chair to the normal position.

25 Claims, 20 Drawing Sheets

TILT CONTROL FOR CHAIR

FIELD OF THE INVENTION

This invention relates to an office chair and in particular, to an office chair which includes seat and back assemblies which are tiltable forwardly and rearwardly relative to a chair base.

BACKGROUND OF THE INVENTION

Office chairs have been developed where seat and back assemblies thereof are tiltable forwardly and rearwardly. One type of office chair is commonly referred to as a synchro-tilt type chair wherein the back assembly tilts synchronously with respect to the seat assembly but at a greater rate As a result, the back assembly tilts relative to the seat assembly as the latter tilts relative to a chair base on which the seat and back are supported. Such synchronous tilting is provided by a tilt control mechanism which mounts to the chair base and joins the back assembly to the seat assembly. Numerous control mechanisms have been developed which effect such tilting.

More particularly these tilt control mechanisms typically include a spring arrangement contained therein which resists the rearward tilting of the seat and back. Preferably the spring arrangements cooperate with a spring adjustment mechanism so as to adjust the load of the spring which resists the rearward tilting. Thus, the amount of force necessary to tilt the seat rearwardly can be manually adjusted to suit each user.

Typically these spring adjustment mechanisms include handles which project out of the tilt control mechanism housing and are rotatable so as to vary the spring load. While a large number of these adjustment mechanisms use adjustment knobs which project downwardly through the bottom of a control housing, providing the adjustment knobs on the side of the tilt control mechanism is easier to operate since a user need not reach down below the seat Examples of tilt control mechanisms having side tension adjustment mechanisms are disclosed in U.S. Pat. Nos. 4,865,384, 4,889,384, 5,106,157, 5,192,114 and 5,385,388.

Accordingly, it is an object of the invention to provide an improved tilt control mechanism for an office-type chair which preferably is a synchro-tilt control It is a further object that the tilt control mechanism include a side-actuated tension adjustment mechanism which acts upon a spring arrangement to vary the spring force tending to urge the seat assembly to a normal forward position. To optimize the space required for the tilt control mechanism, it is a further object that the control mechanism have a low-profile design wherein a combination of front and rear springs is provided. In view thereof, it is an object of the invention that the tension adjustment mechanism act on either the forward or rearward springs. A still further object is to provide a tilt control mechanism wherein the spring arrangement urges the seat forwardly but provides for a drop-off or dwell in the spring load being applied once the seat reaches a rearward position such that the seat can be readily maintained in the rearward position with less force than was required to move the seat to the rearward position.

In view of the foregoing, the invention relates to a tilt control mechanism for a chair which provides for synchronous tilting of the seat and back assemblies. Preferably the tilt control mechanism is supported on a chair base while the seat assembly and back assembly are joined together by the tilt control mechanism. The tilt control mechanism disclosed herein permits both rearward tilting of the seat relative to the chair base while also permitting a corresponding rearward tilting of the back assembly relative to the seat. The tilting of the back assembly is at a different and preferably greater rate than the rearward tilting of the seat which is commonly referred to as "synchro-tilt". The tilt control mechanism also permits forward tilting of the seat relative to the base to further optimize the comfort of a user.

More particularly, the tilt control mechanism includes a box-like control housing which is rigidly secured to the base. The control housing opens upwardly to define a hollow interior and contains the internal components of the tilt control mechanism.

To effect rearward tilting, the control mechanism includes a seat back support member which is hinged to the control housing by a center pivot rod, screws or the like. The back support member extends rearwardly therefrom to support the back assembly. In particular, the center pivot rod defines a first horizontal pivot axis so as to permit vertical swinging of the back support member about this horizontal pivot axis. The back support member forms a lower generally horizontal leg of an L-shaped back upright which supports the back assembly thereon. Thus, the back assembly tilts rearwardly in response to a corresponding swinging movement of the back support member.

The control mechanism further includes a horizontally enlarged top plate which has a front edge portion pivotally secured to the control housing by a front pivot rod, and a rear edge portion slidably secured to the back support member by a rear pivot rod, screws or other suitable fasteners In particular, the rear edge portion of the top plate includes horizontally elongate slots which are formed through the side walls thereof and slidably receive the opposite ends of the rear pivot rod therethrough. Unlike the center and front pivot rods which only provide for pivoting movement, the opposite ends of the rear pivot rod project from the back support member and are movable forwardly and rearwardly along the slots formed in the top plate. Preferably, the opposite ends of the rear pivot rod includes bearings or rollers that roll along the slots so as to reduce friction. Thus, while the control housing remains stationary, the top plate and back support member pivot downwardly together but at different rates during rearward tilting of the chair. While this movement is in a downward direction, the rearward tilting of the seat and back occurs Similarly, upward pivoting of the top plate and back support member effects a forward tilting of the seat and back.

To normally maintain the back assembly in an upright position, the control mechanism includes a front coil spring supported on the front pivot rod, and a pair of rear coil springs supported on the rear pivot rod. These coil springs include lower legs which act downwardly on the stationary control housing and upper legs which act upwardly on the pivotable top plate The front and rear coil springs thereby urge the top plate as well as the back support member upwardly relative to the stationary control housing. The springs, however permit rearward tilting of the top plate and the back support member.

The tension being applied by the coil springs is adjusted by a tension adjustment mechanism. The tension adjustment mechanism includes a wedge block which preferably seats underneath the lower legs of the front springs, and a side-actuatable adjustment rod which is movable laterally into and out of the control housing to move the wedge block forwardly. To transform the lateral movement of the rod into the forward movement of the wedge block, the wedge includes an angled groove on a bottom surface thereof which is seated on an elongate track that projects upwardly from the control housing. The track extends at an angle toward the front of the control housing, and the wedge slidably seats on the track such that the wedge block is slidable therealong at an angle relative to the coil springs. Thus, upon sideward movement of the adjustment rod, the wedge block is moved both sidewardly and forwardly as it travels along the angled track wherein the forward movement of the block tends to urge the lower spring legs upwardly and increase the spring force being applied thereby.

To minimize the effects of the sideward movement of the wedge block on the spring legs, an intermediate plate is disposed between an inclined front surface of the wedge block and a lower surface of the spring legs. By providing the intermediate plate, the sideward movement of the wedge block does not tend to urge the spring legs sidewardly as would otherwise occur if the wedge block acted directly on the spring legs. This tension adjustment mechanism thereby permits ready adjustment of the force provided by the front coil springs.

A further aspect of the chair is provided by the rear springs wherein the lower legs of the springs act upon the control housing, and in particular, act upon an arcuate bearing surface that is supported on a rear edge of the control housing. When the top plate is in the normal horizontal position, the lower spring legs tend to act directly downwardly onto the bearing surface which maximizes the spring forces acting upwardly on the top plate. However, as the top plate and back support member pivot downwardly during rearward tilting of the chair, the rear springs also swing downwardly below the height of the control housing which thereby deflects the lower spring legs. In particular, the lower spring legs deflect from a generally horizontal orientation to a steeply inclined position such that the lower spring legs act more on a side of the arcuate bearing surface instead of the top thereof. Since a substantial portion of the force applied by the lower spring leg now acts forwardly instead of downwardly, the upward acting forces provided by the rear springs are significantly reduced so as to define a dwell for a user. Accordingly, once the chair is tilted rearwardly to its rearward position, a significant reduction in the forces applied by the rear springs occurs which makes it easier for a user to maintain the chair in the rearward position.

Other objects and purposes of the invention, and variations thereof, will be apparent upon reading the following specification and inspecting the accompanying drawings.

Figure 1:
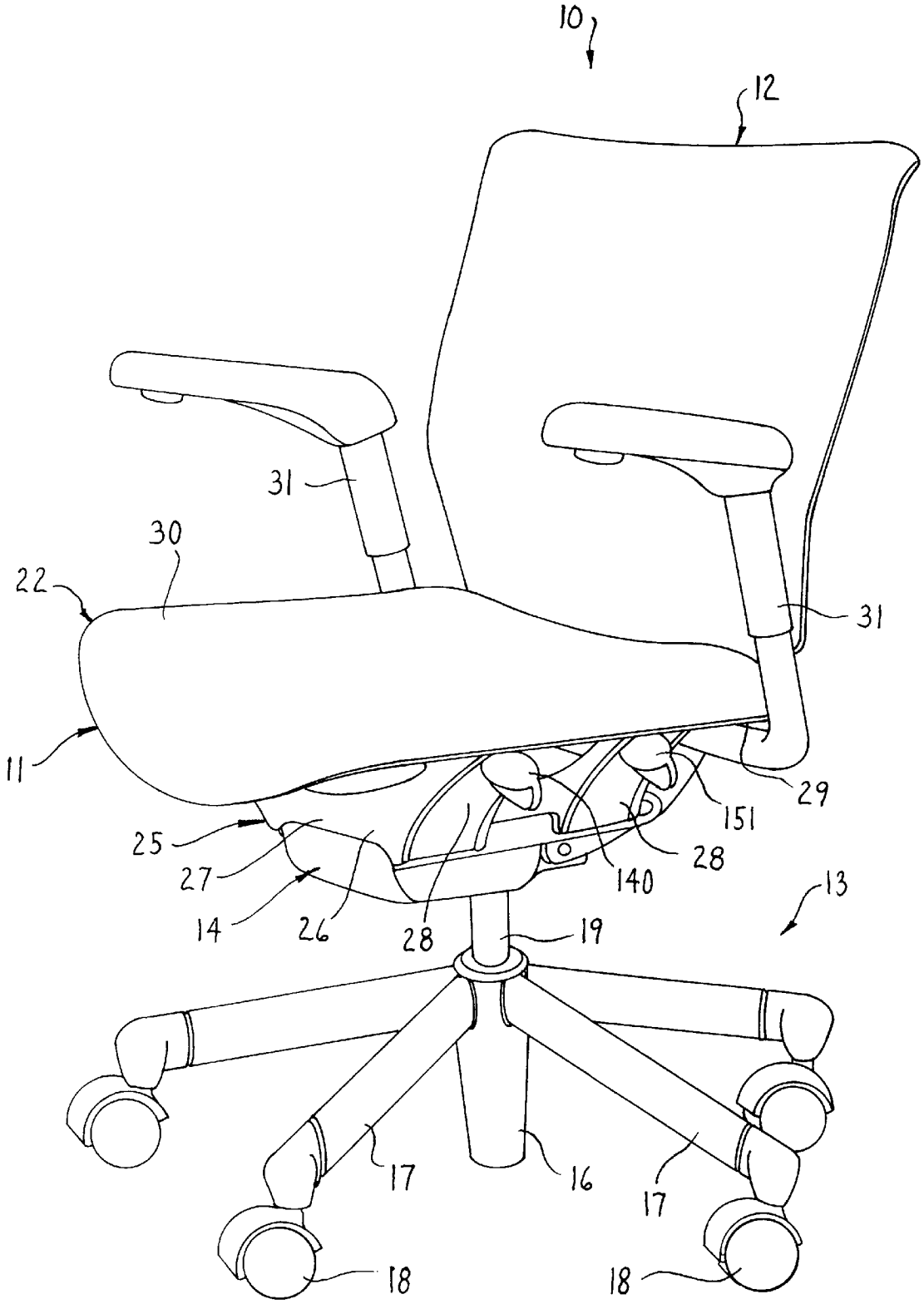
FIG. 1 is a front perspective view of an office chair of the invention.

Certain terminology will be used in the following description for convenience in reference only a and will not be limiting. For example, the words "upwardly", "downwardly", "rightwardly" and leftwardly will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
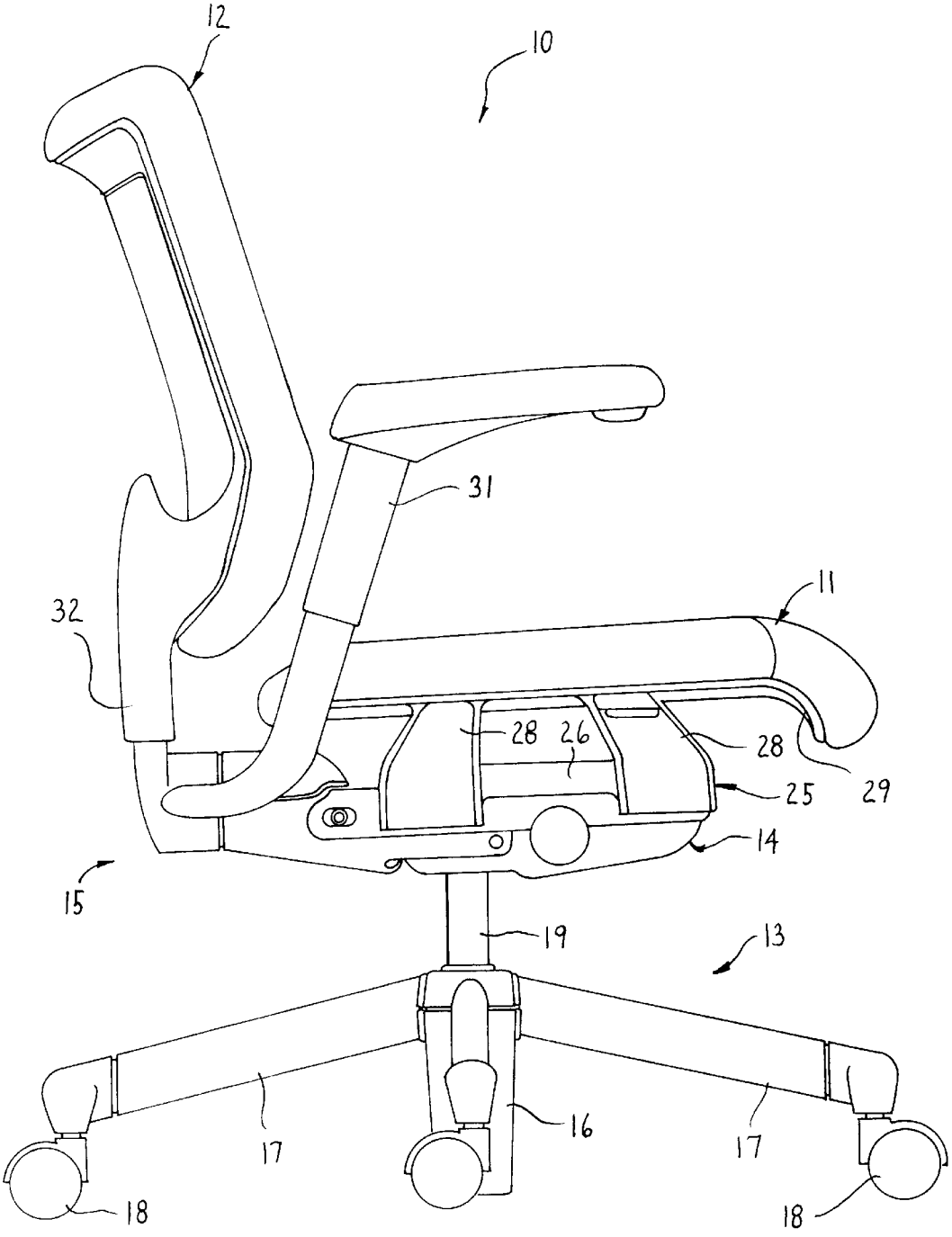
FIG. 2 is a side elevational view of the chair.
Figure 3:
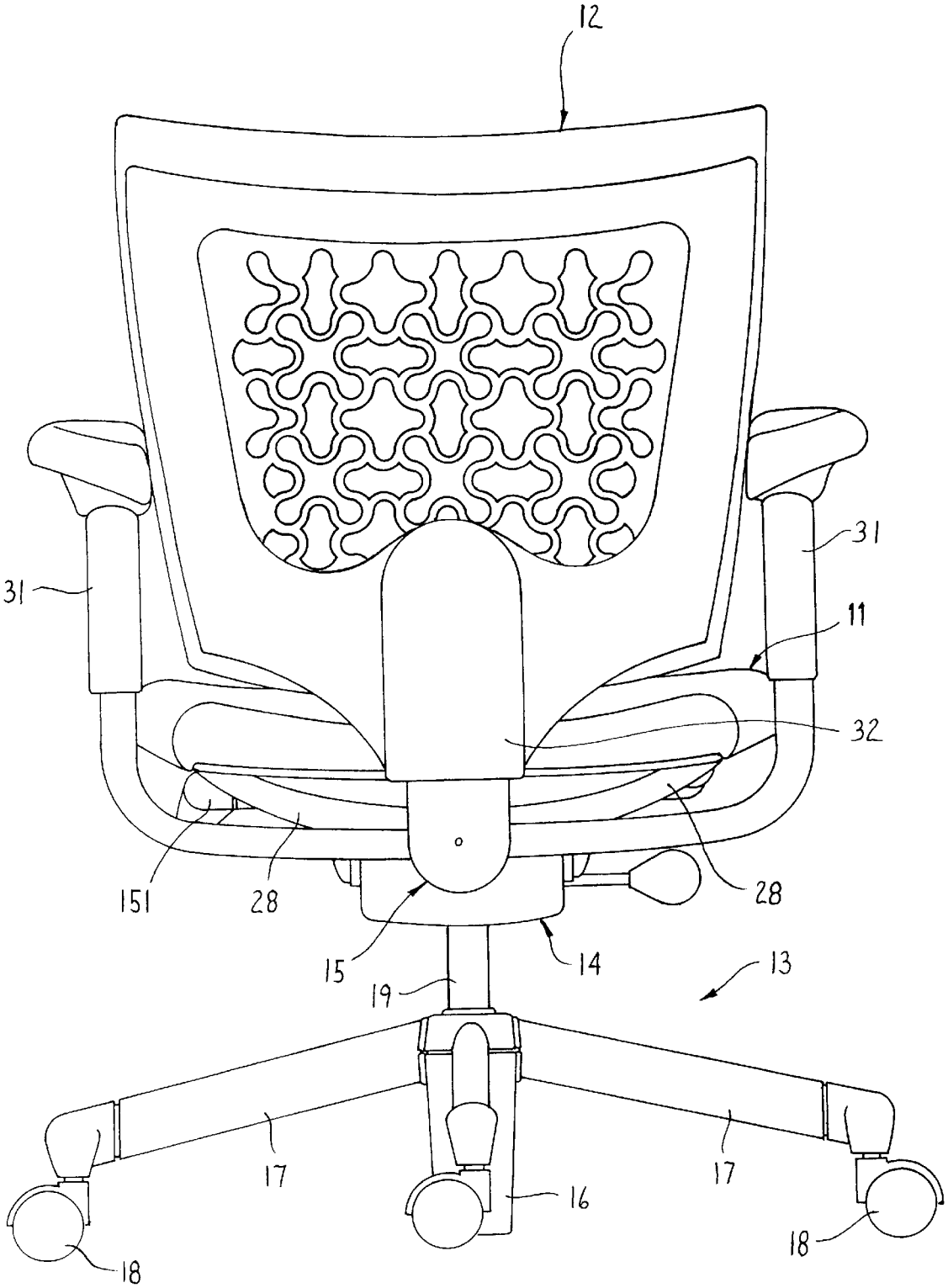
FIG. 3 is a rear elevational view of the chair.
Figure 4:
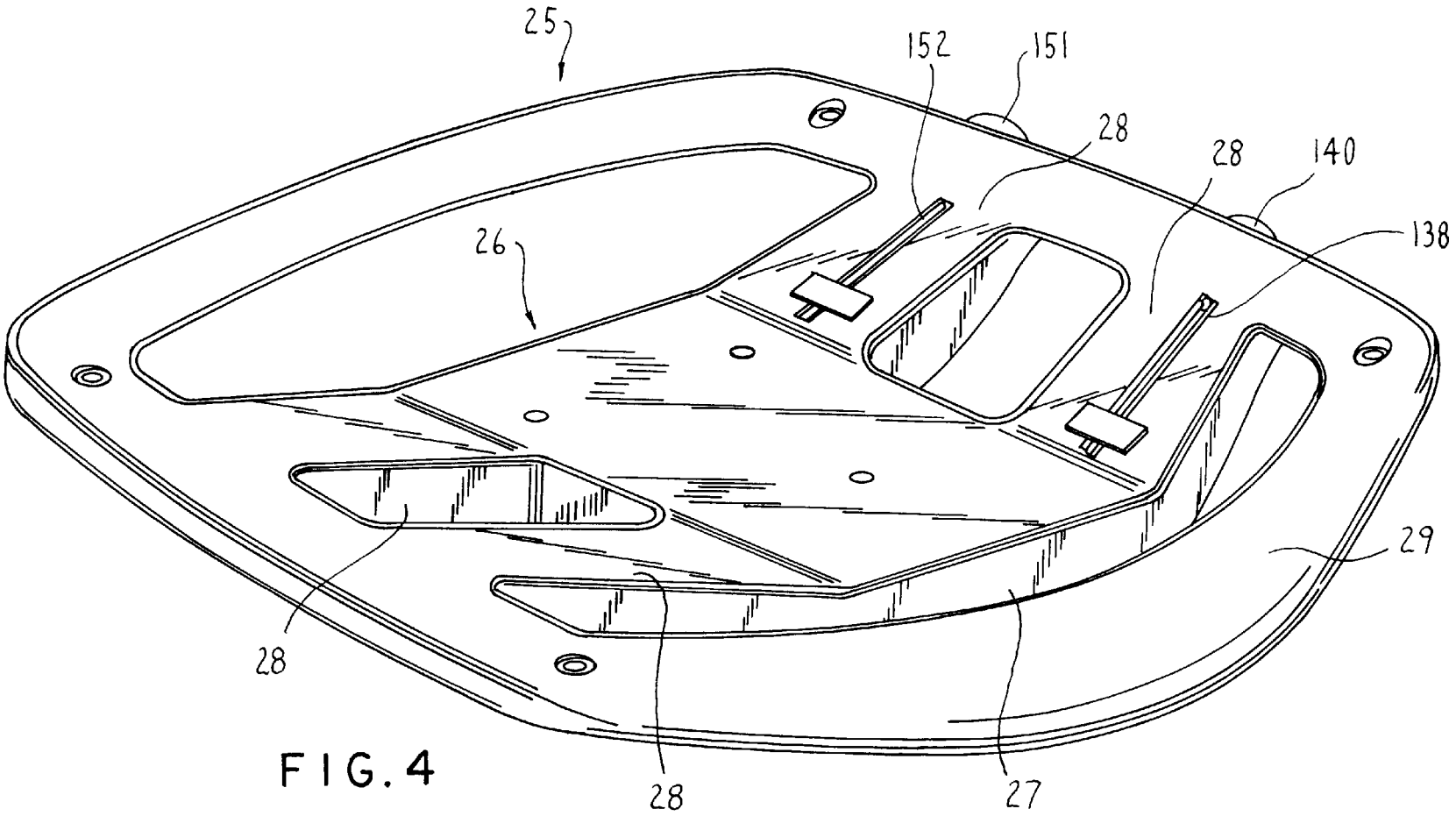
FIG. 4 is an isometric view of a seat support structure.

Referring to FIGS. 1–3, the invention relates to an office-type chair 10 which includes a seat assembly 11 and back assembly 12 which are pivotally supported on a chair base or pedestal 13 to support a user thereon. To increase the comfort of the user, the seat assembly 11 is tiltable forwardly and rearwardly by a tilt control mechanism 14 while the back assembly 12 thereof is tiltable laterally from side to side, i.e. in the leftward and rightward directions by a back torsion mechanism 15.

Generally with respect to the main components of the chair 10, the base 13 is adapted to be supported on a floor and the seat assembly 11 is mounted to the base 13 by the tilt control mechanism 14. The tilt control mechanism 14 thereby permits rearward tilting of the seat assembly 11 relative to the base 14. To improve the comfort of a user, the tilt control mechanism 14 uses a double-spring arrangement which is adjustable as described in more detail hereinafter to urge the chair 10 to a normal upright position.

Further, the back torsion mechanism 15 rigidly joins the back assembly 12 to the seat assembly 11 such that the back assembly 12 pivots rearwardly in response to rearward tilting of the seat assembly 11. At the same time, the back torsion mechanism 15 also defines a forwardly extending horizontal pivot axis whereby the back assembly 12 can be pivoted to the left and right sides. The back torsion mechanism 15 is disclosed in U.S. patent application Ser. No.

08/846,614. entitled CHAIR BACK WITH SIDE TORSIONAL MOVEMENT, filed concurrently herewith (Atty Ref: Haworth Case 216). The disclosure of this latter application, in its entirety, is incorporated herein by reference. This combination of forward-rearward tilting and torsional movement thereby provides three-dimensional chair movement to increase the comfort of a user.

More particularly with respect to the chair 10 and the tilt control mechanism 14, the chair pedestal 13 includes a central hub 16 and a plurality of pedestal legs 17 which project radially outwardly therefrom. The ends of the pedestal legs 17 include casters 18 which are of conventional construction and support the chair 10 on a floor.

Further, the hub 16 supports a vertically elongate spindle 19 which is movable vertically so as to permit adjustment of the height of the chair 10. The spindle 19 is a rigid upright tube wherein the upper end of the spindle 19 supports a bottom of the seat assembly 11 thereon. The spindle 19 also is formed with a pneumatic cylinder therein of conventional construction which tends to move the upright 19 upwardly relative to the hub 16 to raise and lower the chair height. A normally closed control valve 20 (FIG. 10) is formed at the upper end of the upright 19 which can be opened to permit adjustment of the height of the seat assembly 11.

The seat assembly 11 is supported on the upper end of the spindle 19 by the tilt control mechanism 14 which provides for forward and rearward tilting of the chair 10. To support the seat of a user, the seat assembly 11 further includes a cushion assembly 22 which is supported on the tilt control mechanism 14.

The cushion assembly 22 includes a seat support frame 25 (FIGS. 1–4) which mounts to the tilt control mechanism 14. In particular, the seat support frame 25 is supported on the tilt control mechanism 14 by a rectangular center mounting structure 26 which includes a downwardly depending peripheral side wall 27 that is adapted to be fitted over the top of the tilt control mechanism 14. The center mounting structure 26 thereafter is secured to the top of the control mechanism 14 by suitable fasteners.

The seat support frame 25 further includes four support arms 28 which project sidewardly away from the left and right sides of the center mounting structure 26 and extend generally upwardly to support a ring-like rim 29 a predetermined distance above the control mechanism 14. The ring-like rim 29 has a generally annular shape and is open in the central region above the center mounting structure 26. The peripheral rim 29 is adapted to support a horizontally enlarged plastic inner shell (not illustrated) which overlies the open area of the peripheral rim 29 and includes a resiliently flexible membrane in the central region thereof to provide support to a cushion 30 which is attached thereto. The seat and back assemblies 11 and 12 are disclosed in U.S. patent application Ser. No. 08/846,616, entitled MEMBRANE CHAIR, filed concurrently herewith (Atty Ref: Haworth Case 215). The disclosure of this latter application, in its entirety, is incorporated herein by reference.

The back assembly 12 also supports a pair of chair arms 31 which project sidewardly and upwardly from a hub 32 on the lower end of the back assembly 12. The hub 32 is connected to the tilt control mechanism 14 by the back torsion mechanism 15.

Figure 5:
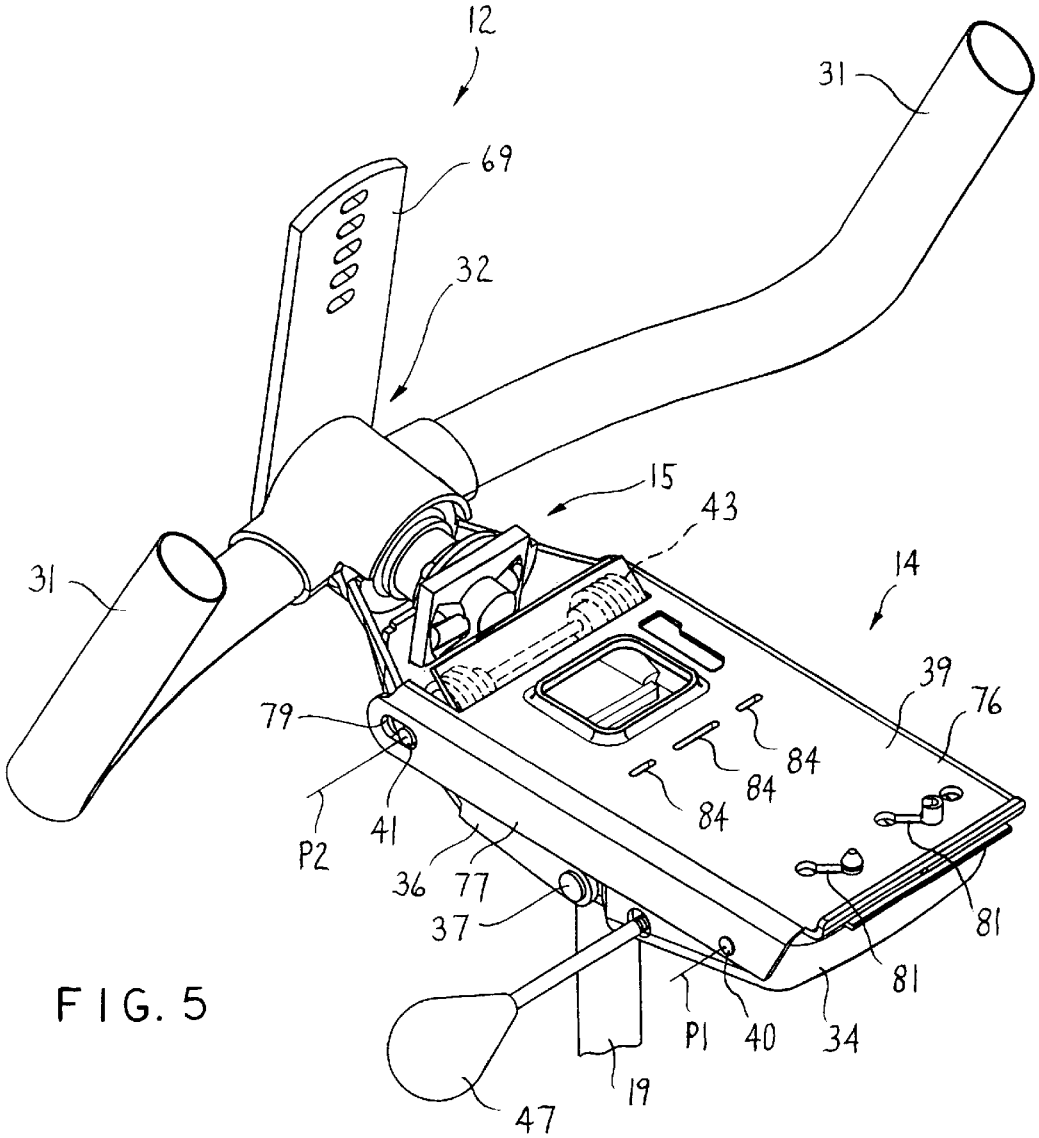
FIG. 5 is a partial perspective view of a tilt control mechanism and an upright assembly supported thereby.
Figure 6:
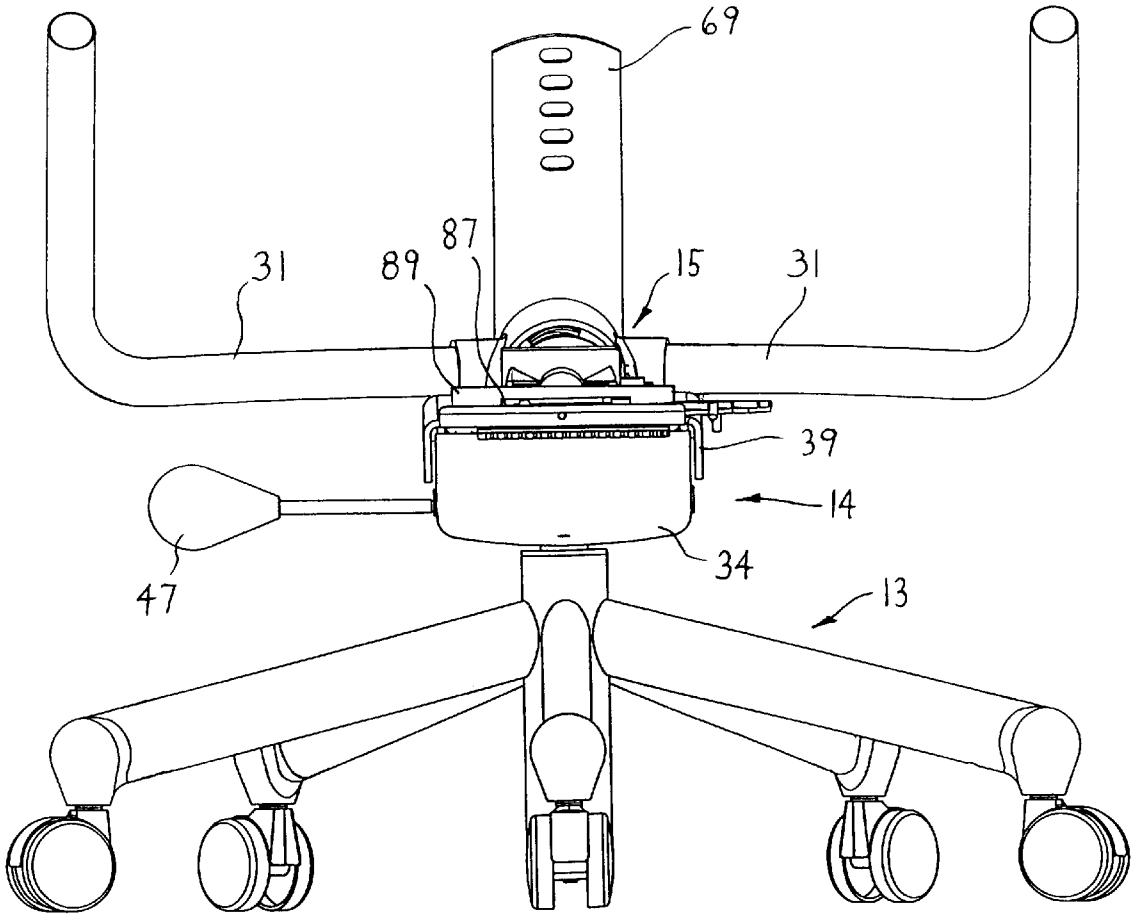
FIG. 6 is a partial front elevational view of the chair.

Generally with respect to the tilt control mechanism 14, these types of mechanisms are used to mount a seat assembly to a chair base and permit rearward tilting of the chair relative to the base. The particular tilt control mechanism 14 (FIGS. 5–7) disclosed herein permits both rearward tilting of the seat 11 relative to the pedestal 13 about a first horizontal pivot axis P1 while also permitting a corresponding rearward tilting of the back assembly 12 relative to the seat about a second horizontal pivot axis P2. Preferably the tilting of the back assembly 12 is at a different and preferably greater rate than the rearward tilting of the seat assembly 11 in the direction of arrow A which arrangement is commonly referred to as a "synchro-tilt" mechanism. The tilt control mechanism 21 also permits forward tilting of the seat 11 relative to the base 13 to further optimize the comfort of a user.

The tilt control mechanism 14 includes a box-like control housing 34 which is rigidly secured to the base 13 and opens upwardly to define a hollow interior. The hollow interior is adapted to contain the internal components of the tilt control mechanism 14 as described in more detail hereinafter. Generally, the interior of the control housing 34 includes a pedestal mounting bracket 35 proximate the rear edge thereof which mounts the control housing 34 to the upper end of the spindle 19. Preferably, the pedestal mounting bracket 35 also permits swivelling of the chair 10 about a vertical axis.

The control mechanism 14 effectively defines a linkage which causes the synchronous tilting of the seat and back assemblies 11 and 12. In particular, the control mechanism 14 includes a seat back support member 36 which is hinged to the control housing 34 by a center or intermediate pivot rod 37. The center pivot rod 37 defines the second horizontal pivot axis P2 and extends sidewardly so as to permit vertical swinging of the back support member 36. Alternatively, screws or other suitable fasteners could be used in place of the rod 37.

The control mechanism 14 further includes a top plate 39 which has a front edge pivotally secured to the front of the control housing 34 by a front pivot rod 40, and a rear edge portion slidably secured to the back support member 36 by a rear pivot rod 41. The front and rear pivot rods 40 and 41 also are oriented horizontally and extend sidewardly, and the front pivot rod 40 defines the first pivot axis P1 about which the top plate 39 pivot. While the control housing 34 remains stationary during use, the top plate 39 and back support member 36 are joined one with the other so as to pivot downwardly together during rearward tilting of the chair 10.

To urge the top plate 39 upwardly and maintain the seat and back assemblies 11 and 12 in the normal position illustrated in FIGS. 1–3, the control mechanism 14 also includes a front coil spring 42 which is supported on the front pivot rod 40, and a pair of rear coil springs 43 which are supported on the rear pivot rod 41 The front coil spring 42 acts downwardly on the control housing 34 and acts upwardly on the top plate 39 so as to resist downward pivoting of the top plate 39. The rear coil springs 43 similarly urge the top plate 39 upwardly so as to assist the front spring 42. The front and rear coil springs 42 and 43 thereby combine to urge the top plate 39 upwardly and tend to maintain the back assembly 12 in the vertically upright position as will be discussed in more detail hereinafter.

The tilt control mechanism 14 also generally includes a tension adjustment mechanism 46 which is actuatable from the side of the control housing 34 by the adjustment knob 47 that projects therefrom. The upward force acting on the top plate 39 thereby can be adjusted so as to make it easier or harder to tilt the seat and back assemblies 11 and 12.

More particularly, with respect to the components of the tilt control mechanism 14, the control housing 34 (FIGS. 10–13) is formed with a bottom wall 51, front wall 52, opposite side walls 53 and a rear wall 54. The front wall 52, side walls 53 and rear wall 54 extend upwardly from the bottom wall 51 so as to define the upward-opening hollow interior thereof.

To support the control housing 34 on the spindle 19, the bottom wall 51 includes an aperture 56 near the rearward end thereof which receives the upper end of the spindle 19 therethrough. The mounting bracket 35 is mounted to the bottom wall 51 to further support the spindle 19. The mounting bracket 35 has a generally U-shape defined by downwardly extending legs 57 which are welded to the housing bottom 51, and a top wall 58 which overlies the aperture 56 formed in the bottom wall 51. The top wall 58 includes a further aperture 59 which is coaxially aligned with the aperture 56 such that the upper end of the spindle 19 is fixedly secured to the mounting bracket 35 by any suitable fastening method such as by welding or a friction fit.

Figure 10:
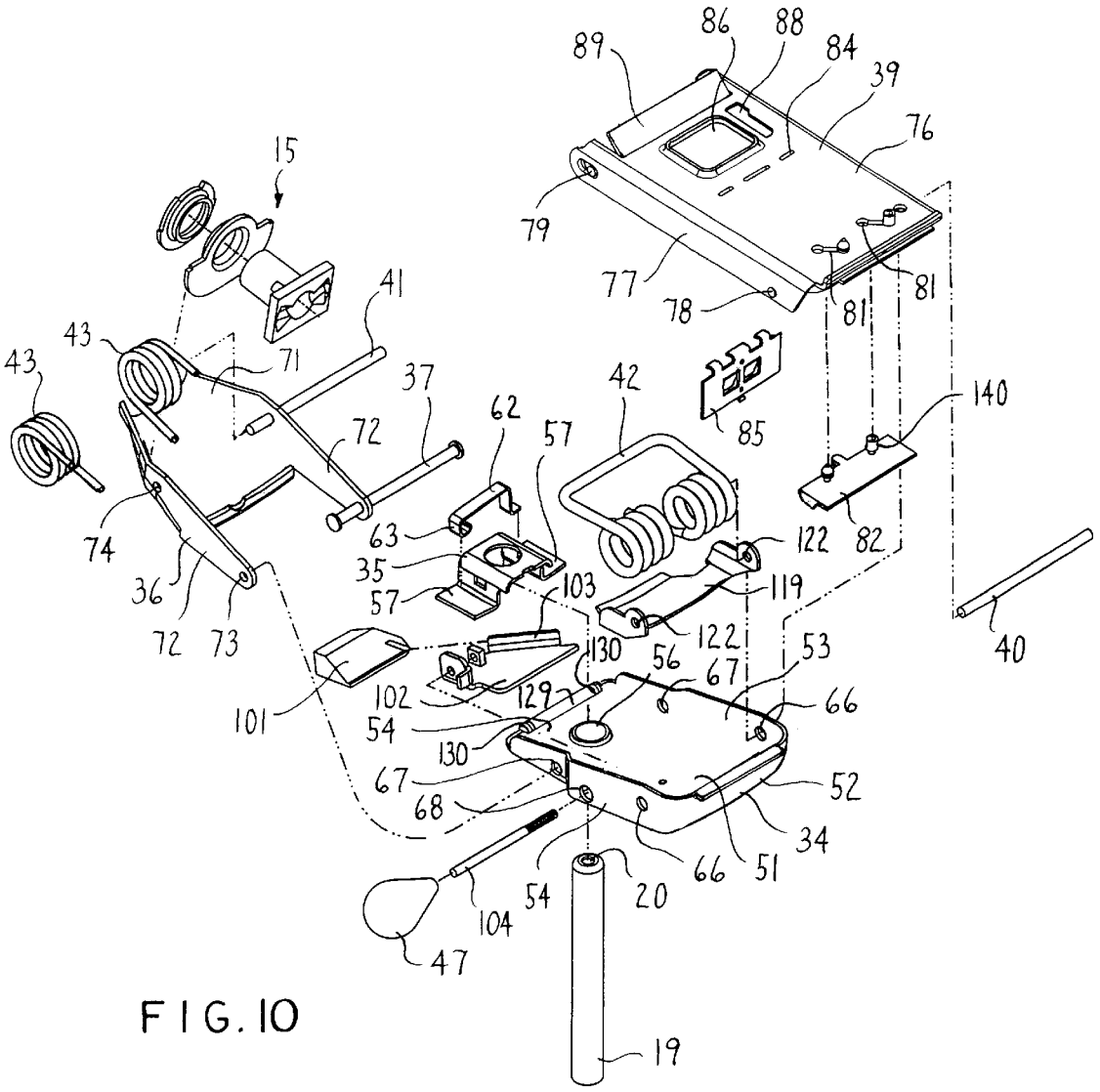
FIG. 10 is an exploded view of the tilt control mechanism.
Figure 11:
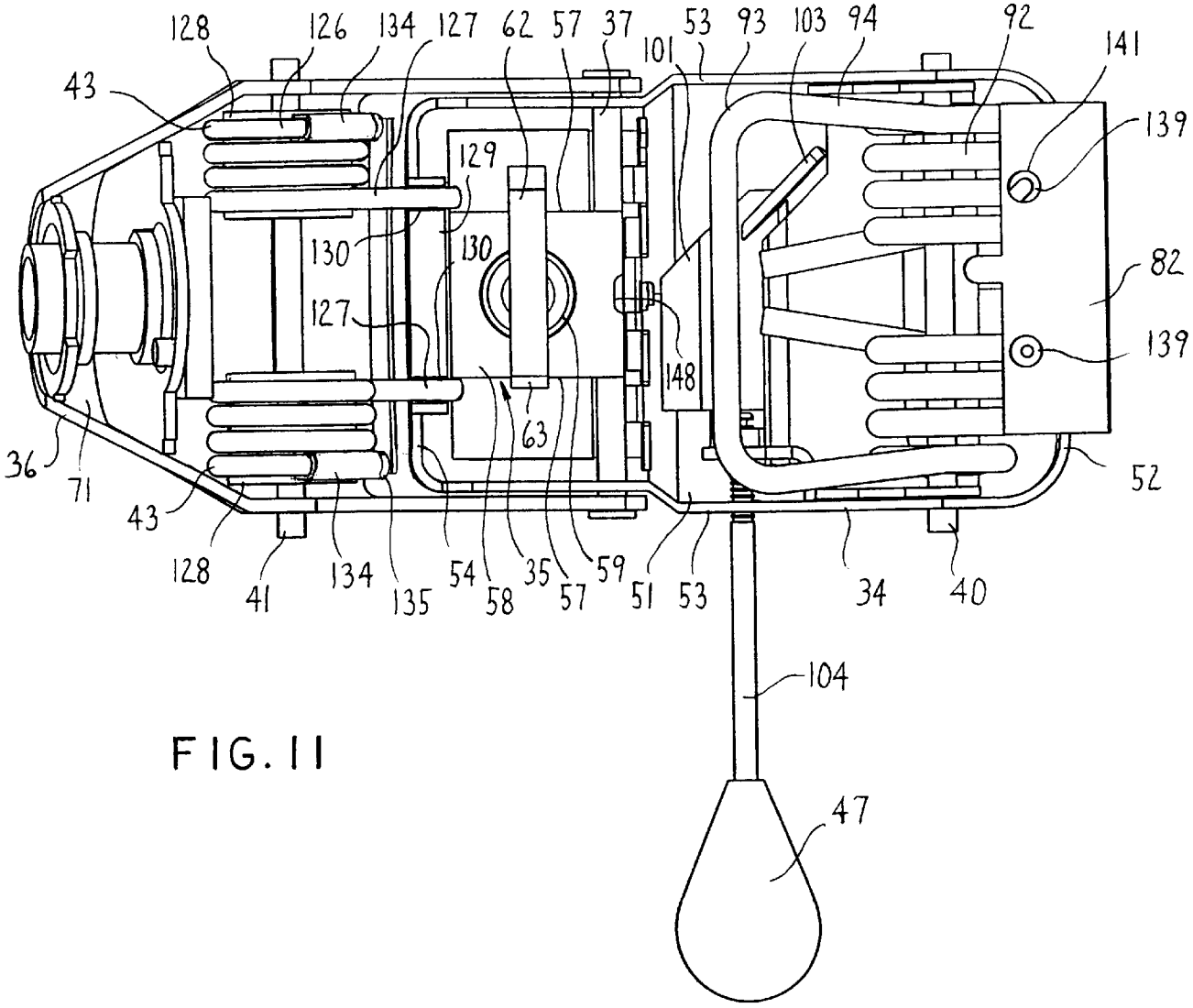
FIG. 11 is a top plan view of the tilt control mechanism with a top plate removed.
Figure 13:
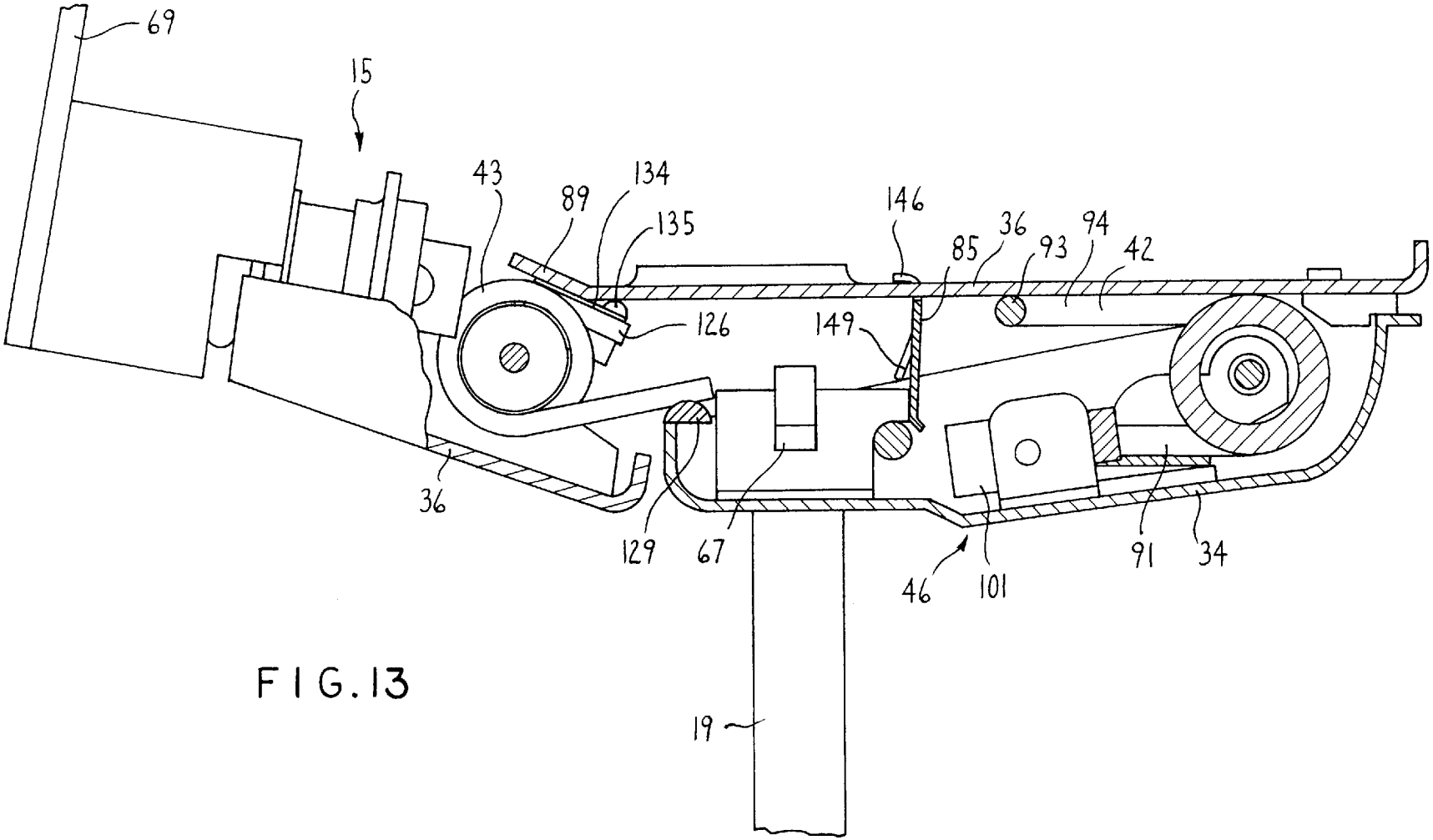
FIG. 13 is a partial side elevational view in partial cross section illustrating the tilt control mechanism as viewed in the direction of arrows 13—13 in FIG. 14.

Referring to FIGS. 10, 11 and 13, the aperture 59 also provides access to the pneumatic control valve 20 of the spindle 19. To actuate the pneumatic cylinder within the spindle 19, the vertical legs 57 of the mounting bracket 35 include openings 61 on the opposite sides thereof. An actuation bracket or lever 62 is provided which has a hooked end 63 which engages one of the openings 61 such that the lever 62 extends over the aperture 59 and is movable upwardly and downwardly. The opposite end of the lever 62 includes a downward leg which moves vertically. While the remaining components for actuating the lever 62 have been omitted from FIG. 10 for the sake of clarity and are not required for an understanding of the invention disclosed herein, the lever 62 is adapted to open the control valve 20 in response to downward pivoting of the lever 62 which thereby permits adjustment of the seat height.

To join the top plate 39 and back support member 36 to the control housing 34 as generally described above, the opposite side walls 53 of the control housing 34 include front apertures 66 and rear apertures 67. The front apertures 66 receive the front pivot rod 40 for connecting the top plate 39 thereto, while the rear apertures 67 receive the center pivot rod 37 for connecting the back support member 36 thereto. The left side wall 53 further includes a middle aperture 68 for the adjustment knob 47.

To support the back assembly 12 on the control housing 34, the back support member 36 includes an upward-opening rearward end section 71 to which the back assembly 12 is connected by the back torsion mechanism 15. In particular, the back assembly 12 includes a rigid vertical upright 69 and the back torsion mechanism 15 rigidly connects the lower end of the upright 69 to the back support member 36. As a result, the upright 69 moves in combination with the back support member 36 while the back torsion mechanism 15 permits sideward tilting of the upright 69 and in particular, sideward tilting of the back assembly 12 which is supported by the upright 69.

The back support member 36 also includes a pair of pivot arms 72 which project forwardly from the rearward end section 71 and are pivotally secured to the side walls 53 of the control housing 34 by the intermediate pivot rod 37. The pivot arms 71 include coaxially aligned apertures 73 at the forward ends thereof which are supported on the center pivot rod 37.

More particularly, the center pivot rod 37 extends sidewardly or laterally through the aligned apertures 67 and 73 formed in the side walls 53 and pivot arms 72 respectively As a result, the center pivot rod 37 defines the second horizontal pivot axis P2 such that the back support member 36 moves vertically or pivots.

To connect the top plate 39 to the back support member 36, the rearward end section 71 also includes coaxially aligned apertures 74 formed through the side walls thereof. The apertures 74 receive the rear pivot rod 41 therethrough to connect the top plate 39 and back support member 36 together as described in more detail hereinafter.

Figure 14:
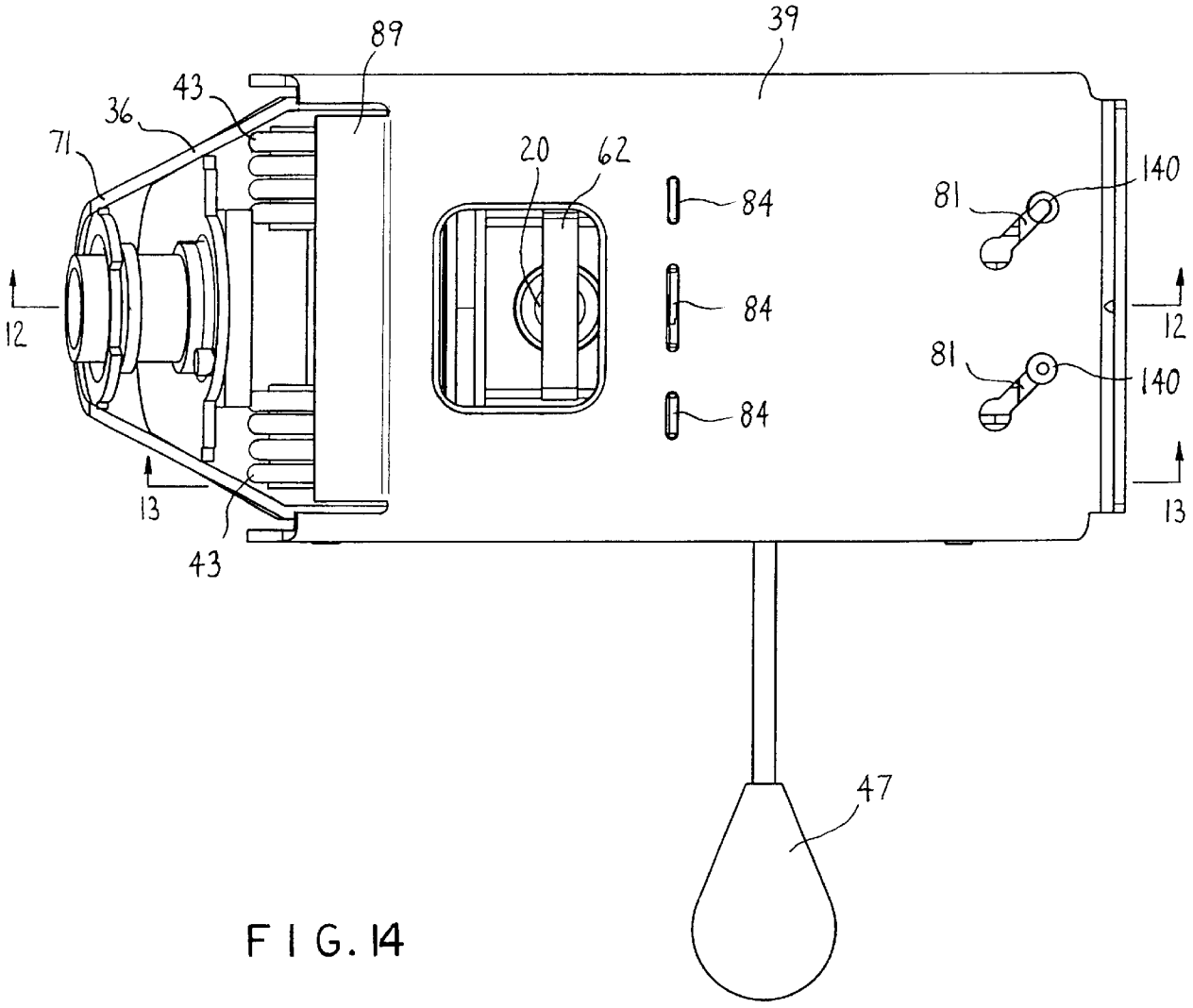
FIG. 14 is a top plan view of the tilt control mechanism.

The top plate 39 (FIGS. 10 and 14) includes a horizontal top wall 76 and downwardly extending side walls 77 so as to seat over the control housing 34 and a portion of the back support member 36. The side walls 77 also include a pair of coaxially aligned front apertures 78 which receive the front pivot rod 40 therethrough. As a result, the front section of the side walls 77 is secured to the housing 34 by the front pivot rod 40 which permits vertical pivoting of the top plate 39 about the pivot axis P1. This vertical pivoting of the top plate 39 permits corresponding tilting of the seat assembly 11 which is connected thereto.

The rear section of the side walls 77 also includes horizontally elongate slots 79 through which the opposite ends of the rear pivot rod 41 project. Thus, unlike the center and front pivot rods 37 and 40 respectively which only permit pivoting movement, the rear pivot rod 41 is slidable along the slots 79 generally in the direction of reference arrow E. In particular, the slots 79 permit both rotational and translational movement of the rear pivot rod 41.

Once the control housing 34, back support member 36 and top plate 39 are pinned together by the center, front and rear pivot rods 37, 40 and 41 as described above, vertical pivoting of the top plate 39 about axis P1 causes a corresponding vertical pivoting of the back support member 36 about axis P2. This vertical pivoting of the back support member 36 thereby results in the forward and rearward tilting of the back assembly 12 which projects upwardly therefrom.

Figure 7:
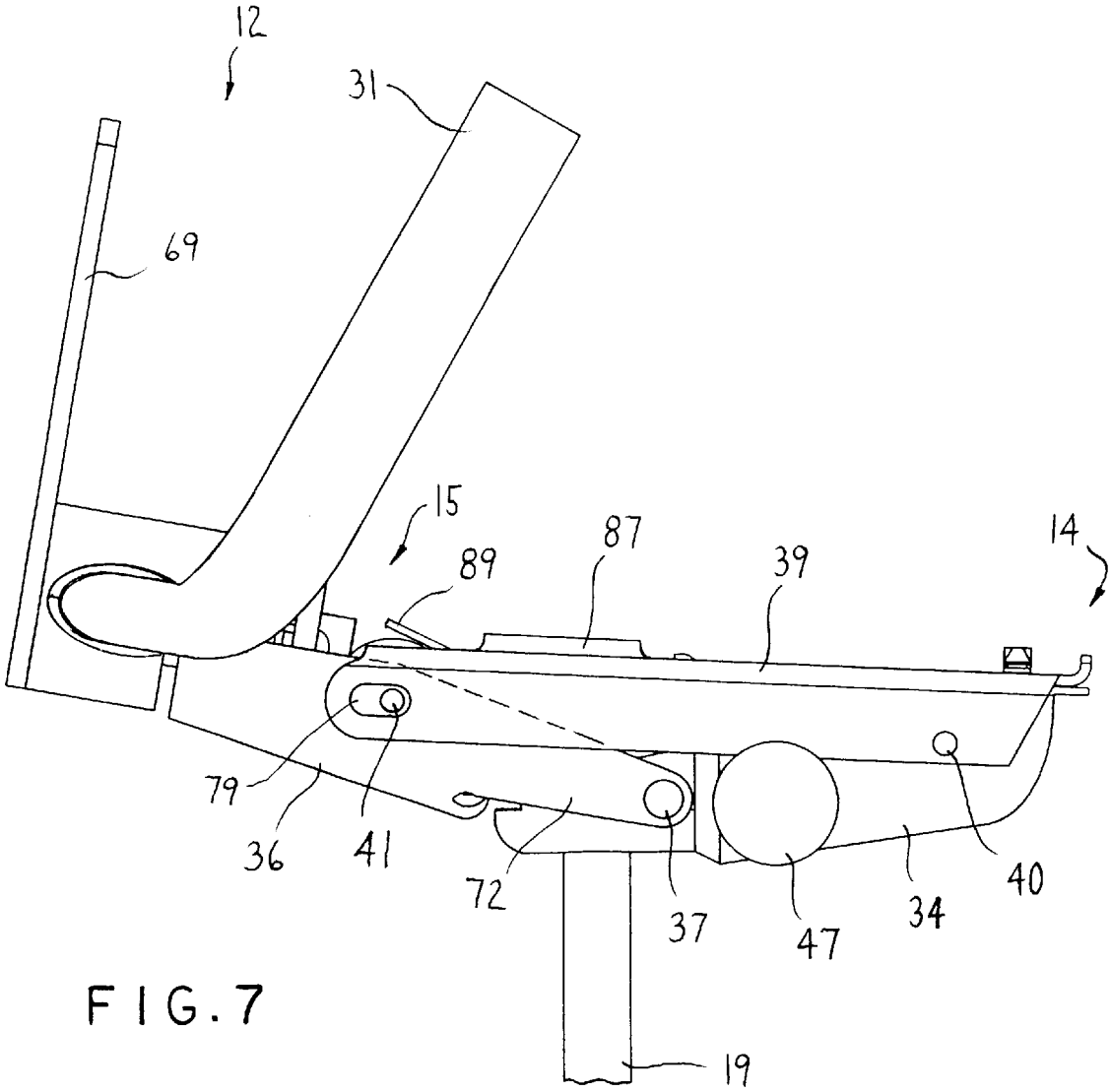
FIG. 7 is a partial side elevational view of the tilt control mechanism illustrated in a forwardly tilted position.
Figure 8:
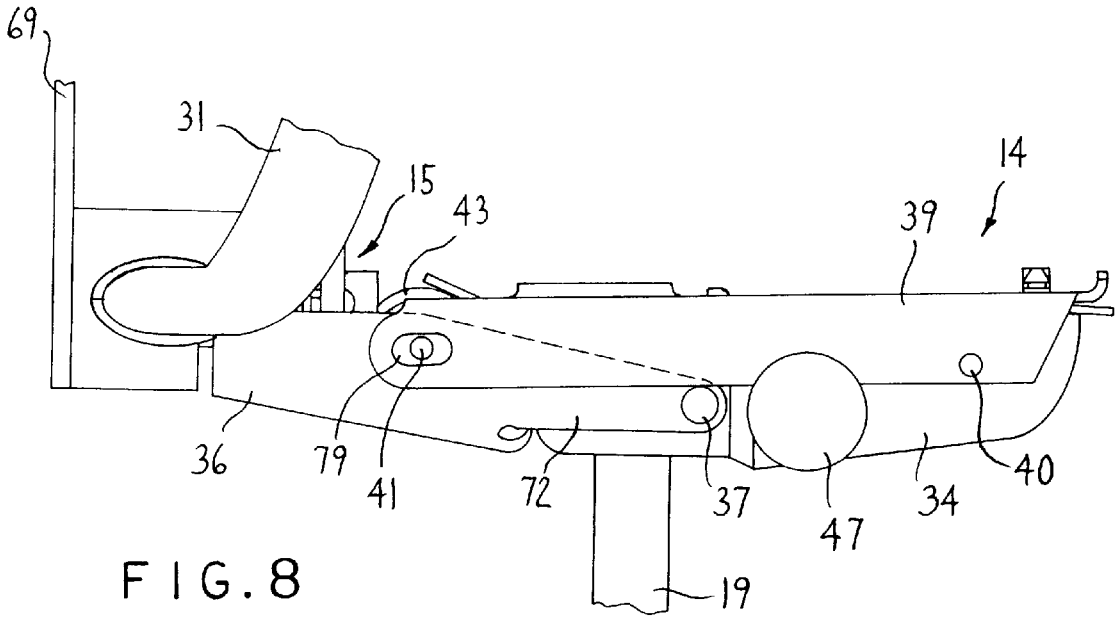
FIG. 8 is a partial side elevational view of the tilt control mechanism illustrated in a normal generally horizontal position.
Figure 9:
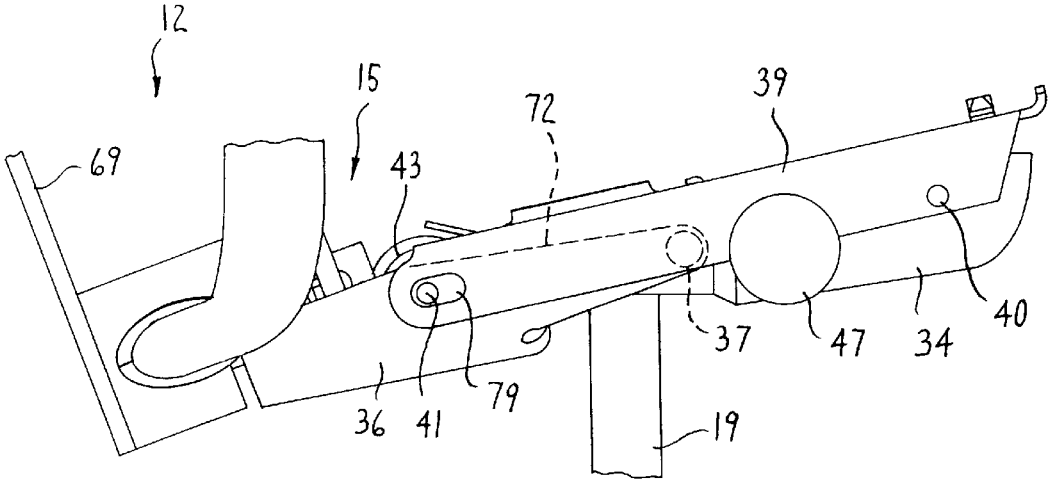
FIG. 9 is a partial side elevational view of the tilt control mechanism illustrated in a rearwardly tilted position.

During use, as seen in FIGS. 7–9, the top plate 39 is pivotable by a user between a forwardly inclined position (FIG. 7) and a rearwardly declined or tilted position (FIG. 9). In the forwardmost positions the rear pivot rod 41 slides forwardly to a front end of the slots 79. In this forward position, the top plate 39 is inclined at an angle of approximately 3° relative to a horizontal plane while the back upright 69 is tilted forwardly of a vertical plane at an angle of 10°. Since the rear pivot rod 41 is able to slide along the length of the slot 79, the top plate 39 can be rearwardly pivoted to a normal seating position illustrated in FIG. 8. In this normal position, the rear pivot rod 41 is disposed generally at the midpoint of the elongate slot 79 wherein the top plate 39 preferably is reclined at an angle of approximately relative to the horizontal plane and the upright 69 is tilted rearwardly of the vertical plane at an angle of 0°. Upon further rearward pivoting of the top plate 39, the rear pivot rod 41 moves to the rearward end of the slot 79. In this rearward position, the top plate 39 preferably is reclined at an angle of approximately −12° relative to the horizontal plane while the upright 69 is at 20°.

As can be seen, the back assembly 12 pivots rearwardly as the top plate 39 pivots. However, the back support member 36 and accordingly, the back assembly 12 which is connected to this back support member 36 tilts rearwardly at a greater rate than the top plate 39. This tilting of the top plate 39 and back support member 36 at different rates is commonly referred to as synchronous tilting or in other words, the tilt control mechanism 14 is referred to as a "synchro-tilt" mechanism. Preferably, the tilt differential between the top plate 39 and back support member 36 is approximately a two-to-one ratio wherein as the top plate 39 tilts rearwardly or downwardly 5° the back upright 69 pivots rearwardly approximately 10°.

The top wall 76 (FIGS. 10 and 14) also includes a pair of angled slots 81 near the front edge thereof which are adapted to support a front tilt lock plate 82 as will be described in more detail hereinafter. The angled slots 81 preferably have one end which is enlarged similar to a keyhole shape for engagement with the front tilt lock plate 82.

In the middle region of the top wall 76, three sidewardly elongate slots 84 are formed which pivotally receive a rear tilt lock plate 85 as also will be discussed in more detail hereinafter. Still further, a rectangular central opening 86 is formed rearwardly of the slots 84 and is located directly above the spindle mounting bracket 35 in the control housing interior. Preferably, the periphery of the opening 86 is defined by an upturned lip 87 which provides additional rigidity to the top wall 76. On the right side of this opening 86, a further opening 88 is formed through the top wall 76 so as to permit an actuator mechanism (not illustrated) to extend therethrough for actuating the rear tilt lock plate 85. Further, the rear edge of the top wall 76 includes an inclined flange 89 which projects upwardly and rearwardly therefrom and at least partially overlies the rear coil springs 43.

Figure 12:
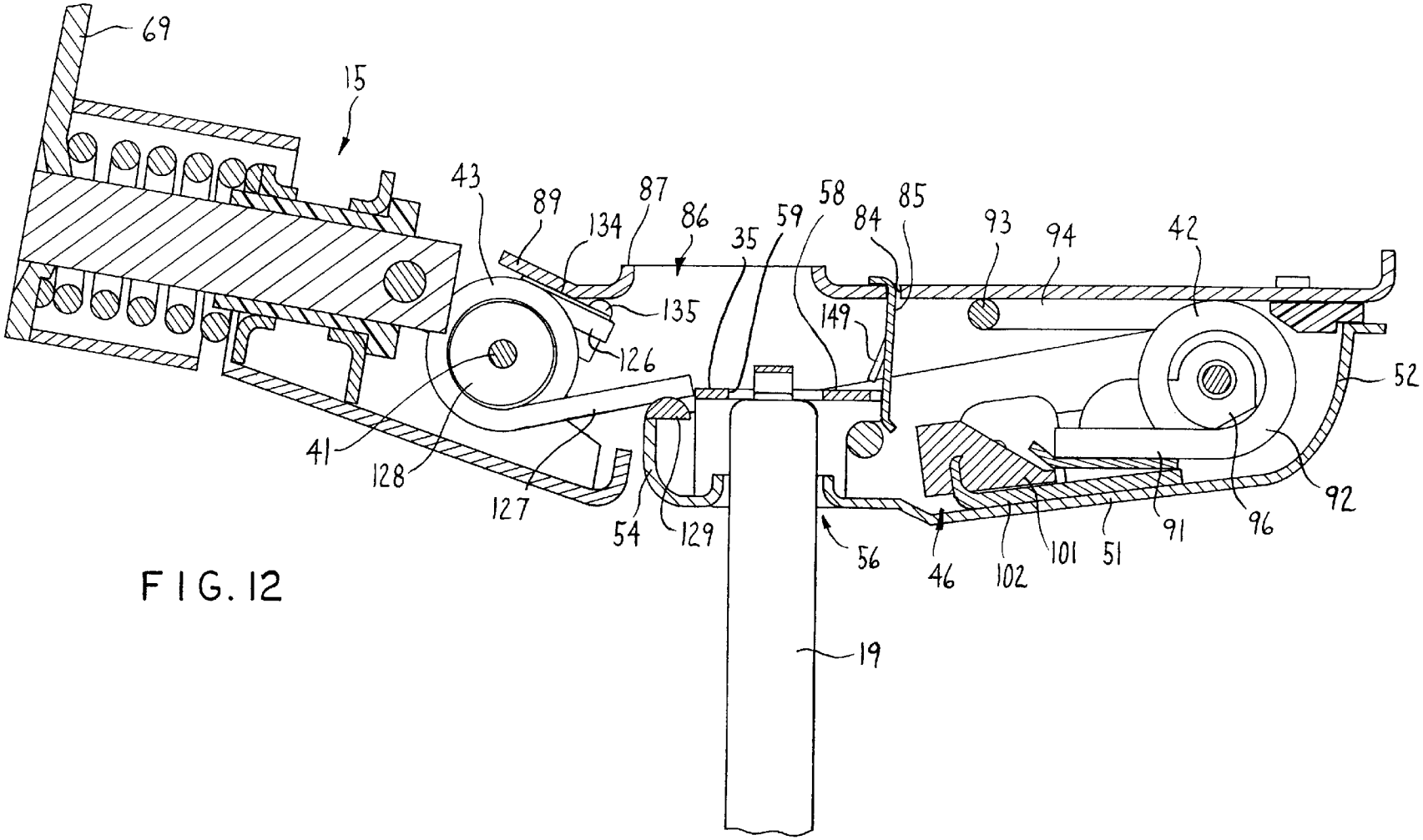
FIG. 12 is a partial side elevational view in cross-section illustrating the tilt control mechanism as viewed in the direction of arrows 12—12 in FIG. 14.

Referring to FIGS. 11 and 12, the tilt control mechanism 14 further includes a spring arrangement within the hollow interior of the control housing 34 which acts upwardly on the top plate 39 so as to normally urge the back assembly 12 and seat assembly 11 to the forward position (FIG. 7). This spring arrangement, however, permits rearward tilting of the seat and back assemblies 11 and 12 in response to movement by a user.

This spring arrangement preferably includes the aforementioned front spring 42 and the rear springs 43. Both the front and rear springs 42 and 43 act upwardly on the top plate 39.

More particularly, the front spring 42 preferably is formed from a single length of a coil spring material. Accordingly, the front spring 42 includes lower legs 91 which are defined by the opposite ends of the coil spring material, a plurality of adjacent spring coils 92 and a bridging section 93 which extends sidewardly between the opposite end coils 92 to define an upper leg 94 of the spring 42.

To support the front spring 42 in the control housing 34, the front pivot rod 40 extends coaxially through the center of the spring coils 92 and includes a hollow cylindrical plastic spacer 96 (FIG. 15) which supports the spring coils 92 thereon. The coils 92 fit closely about the outer circumference of the spacer 96, and the lower and upper spring legs 91 and 94 preferably extend rearwardly away from the housing front wall 52.

The upper spring leg 94 thereby acts upwardly on the bottom surface of the top plate 39, while the lower spring legs 91 act downwardly toward the housing bottom wall 51. While the front spring 42 is resiliently flexible and permits downward pivoting of the top plate 39, the spring 42 applies an upward acting spring force to return the top plate 39 to the forward position.

To adjust the tension in the front coil spring 42, the side tension adjustment mechanism 46 (FIGS. 10, 12 and 15) is provided within the control housing 34 and preferably acts on the lower legs 91 to adjust the spring force applied against the top plate 39.

Generally, the tension adjustment mechanism 46 includes a plastic wedge block 101 which is movable forwardly and rearwardly so as to raise and lower the lower legs 91 and increase and decrease the spring tension respectively. The tension adjustment mechanism 46 includes a steel guide plate 102 that defines an upturned angled track 103 on which the wedge block 101 is slidably engaged. The wedge block 101 slides forwardly along the track plate 102 in response to sideward pushing by the tension adjustment knob 47. In particular, the adjustment knob serves to drive an elongate shaft 104 sidewardly against the wedge block 101 wherein the wedge block 101 slides at an angle along the angled track 103 so as to move both sidewardly and forwardly underneath the lower legs 91. By suitable movement of the adjustment shaft 104, the wedge block 101 is moved forwardly or rearwardly to adjust the position of the lower legs 91.

More particularly, the track plate 102 includes a planar bottom section 106 which is welded onto the bottom wall 51 of the control housing 34 such that the track 103 remains stationary. The plate 102 also includes an upstanding support flange 107 which has an aperture 108 for receiving the adjustment shaft 104 To support the flange 107, a brace 109 (FIGS. 13 and 15) extends sidewardly from the flange 107 and is welded to the housing side wall 53. Further, the track plate 102 includes an adjustment nut 111 (FIG. 15) which is welded on the inner side of the support flange 107 and is threadingly engaged with the adjustment shaft 104. As a result, the adjustment shaft 104 is laterally movable into and out of the control housing 34.

To slidably guide the wedge 101, the track 103 is formed along one edge of the bottom section 106, and extends upwardly therefrom The track 103 preferably is formed at an angle of approximately 45° relative to the axis of the front pivot rod 40.

With respect to the adjustment shaft 104, the distal end thereof includes a threaded portion 112 as well as a convex drive knob 113 at the end thereof. The threaded portion 112 is engaged with the adjustment nut 111 such that rotation thereof causes the shaft 104 to be moved laterally toward and away from the wedge 101. Preferably the threaded engagement of the adjustment shaft 104 and the stationary nut 111 is through "acme" type threads which make it easier for a user to rotate the adjustment knob 67.

The drive knob 113 abuts against the side of the wedge block 101 to push the wedge 101 sidewardly as the shaft 104 is advanced into the control housing 34 as described in more detail hereinafter. Since the wedge 101 also moves forwardly as it moves along the track 103, the drive knob 113 is convex to reduce its contact area with the wedge 101 and reduce friction therebetween during forward movement of the wedge 101.

To move the wedge block 101, the bottom surface of the wedge block 101 includes a channel 116 which preferably is formed at an angle in the range of 35°–55° and preferably at approximately a 45° angle. The angle of the channel 116 corresponds to the angle of the track 103. The channel 116 is adapted to receive the track 103 therein so that the wedge 101 is freely slidable therealong in response to the sideward movement of the adjustment shaft 104.

Preferably, the wedge block 101 is formed of an acetal or other suitable plastic or low-friction material which freely permits sliding of the wedge block 101. To further decrease friction, the wedge block 101 is formed with additional shallow channels (not illustrated) on the bottom surface thereof which are parallel to the deep channel 116 and thereby reduce the overall surface area on the bottom of the wedge block 101 which is in contact with the track plate 102.

Figure 15:
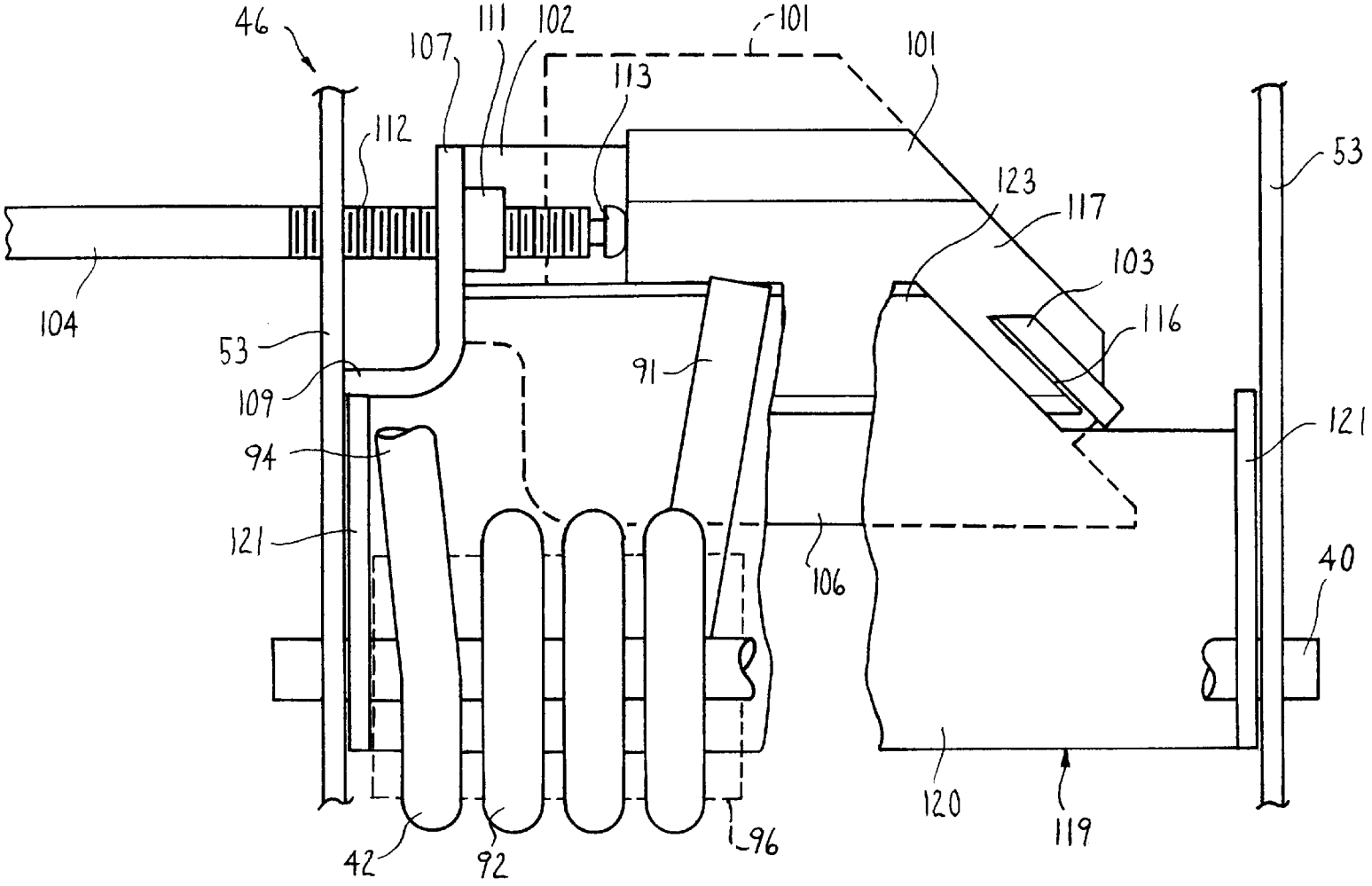
FIG. 15 is an enlarged top plan view of a tension adjustment mechanism.
Figure 16:
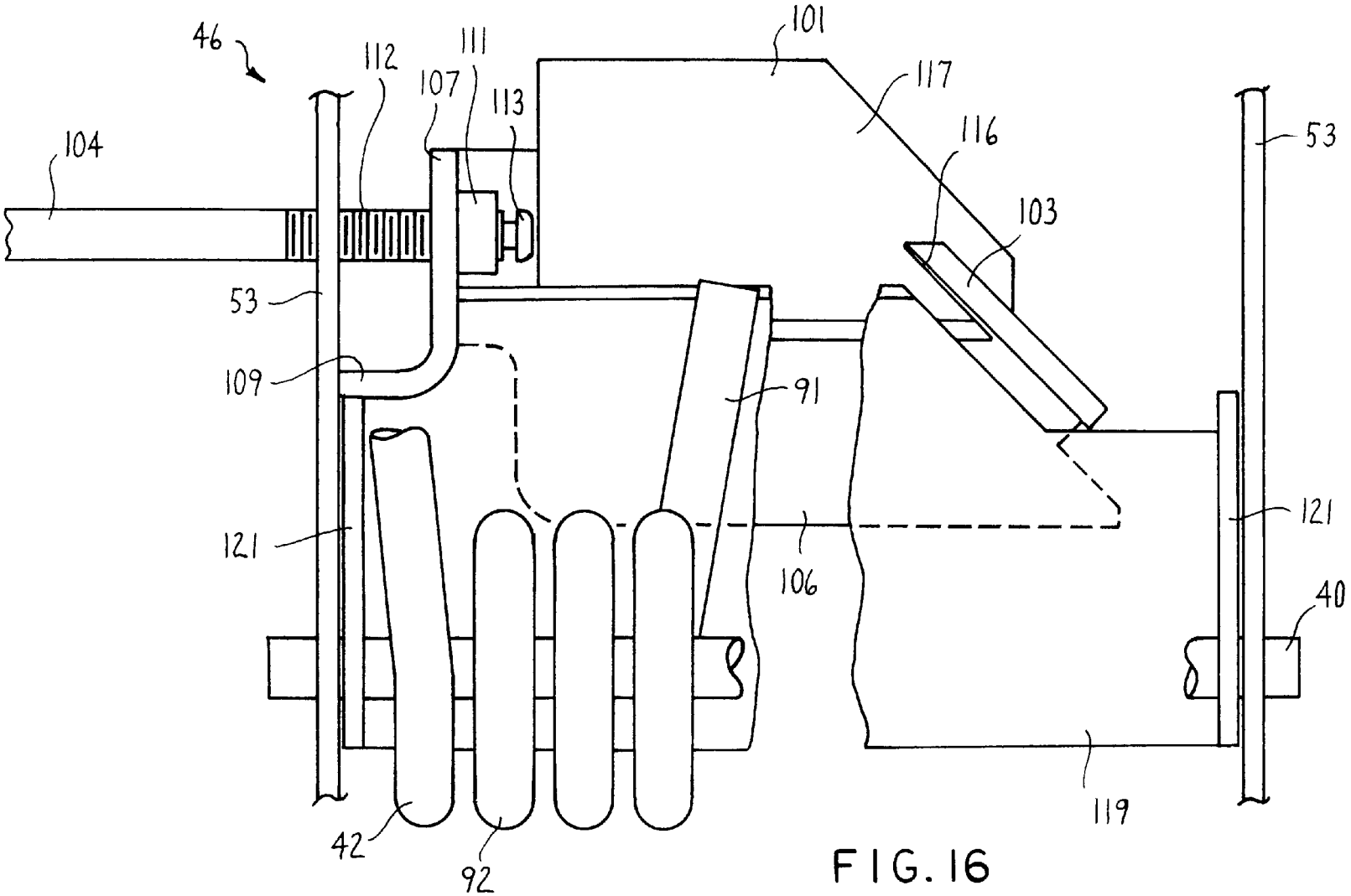
FIG. 16 is an enlarged top plan view of the tension adjustment mechanism in a withdrawn position
Figure 17:
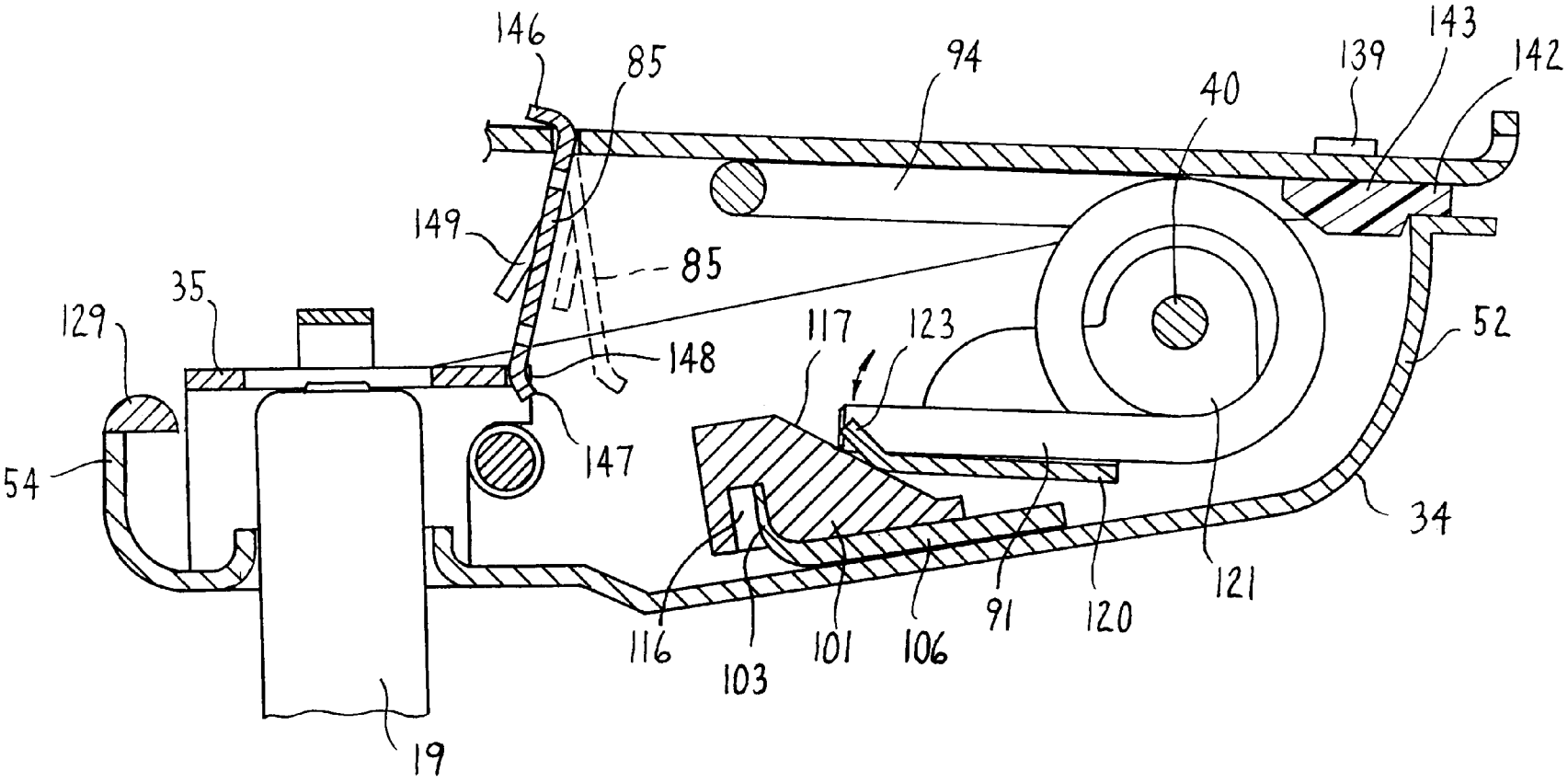
FIG. 17 is an enlarged partial side elevational view in cross section illustrating the tension adjustment mechanism of FIG. 16.

Accordingly, in response to rotation of the adjustment shaft 104, the shaft 104 is advanced or moved sidewardly as generally illustrated in FIGS. 15 and 16 so as to apply a sideward driving force on the side surface of the wedge block 101. However, since the wedge block 101 is slidably engaged with the guide track 103 the wedge 101 thereby moves at an angle along the track 103 between a withdrawn position (FIGS. 12 and 16) and an inserted position (FIGS. 15 and 17). This movement along the track 103 has both a sideward component of motion as well as a forward component of motion. It is the forward component of motion that serves to drive lower spring legs 91 upwardly as seen in FIG. 17.

The wedge block 101 preferably has an inclined surface 117 on the front face thereof which is inclined at an angle in the range of 30°–50° and preferably at an angle of approximately 40° relative to the bottom surface of the wedge 101 and serves to raise and lower the lower spring leg 91. The angle of the inclined surface 117 can be varied although it is selected so as to permit free sliding of the wedge block 101 underneath the spring legs 91 while at the same time, being sufficiently steep such that the downward force of the spring legs 91 tends to urge the wedge block 101 rearwardly. Thus, when the adjustment shaft 104 is backed out of the control housing 34 (FIG. 16), the wedge block 101 is pressed rearwardly by the lower spring legs 91 to slide back up the track 103. Accordingly, the drive knob 113 of the shaft 104 need only abut against the side of the wedge block 101 and a positive connection is not required therebetween. As the wedge block 101 is driven sidewardly and forwardly, the side surface of the wedge 101 slides freely along the drive knob 113 in the forward direction.

Preferably, the tension adjustment mechanism 46 also includes an intermediate support plate 119 which is provided between the inclined surface 117 of the wedge 101 and the bottom of the lower spring legs 91. The support plate 119 (FIG. 10) includes a central section 120 (FIGS. 10 and 15)which is placed between the wedge 101 and the lower spring legs 91.

To mount the support plate 119 in position, the central section 120 is formed with upturned flanges 121 on the opposite sides thereof The flanges 120 include apertures 122 which are adapted to receive the front pivot rod 40 therethrough such that the support plate 119 is movable upwardly and downwardly about the front pivot rod 40. The support plate 119 also includes an inclined flange 123 along the rearward free edge thereof. To avoid interference with the upstanding track 103, the plate 119 is notched on the right side thereof.

When the plate 119 is supported on the pivot rod 40, the plate 119 supports the lower spring legs 91 on an upper surface thereof. During operation, the inclined surface 117 of the wedge 101 slides underneath the support plate 119 to drive the plate 119 as well as the lower spring legs 91 upwardly.

The support plate 121 thereby serves several functions in that the inclined flange 123 provides an inclined surface 123 which slides up the wedge 101 to provide for smooth sliding of the wedge 101. The inclined flange 123 also prevents the direct contact of sharp edges, such as the ends of the lower legs 91, with the inclined wedge surface 117 which might otherwise gouge the inclined surface 117. Further, the support plate 119 distributes the forces being applied by the lower spring legs 91 over the central plate section 120 which avoids localized forces that might be applied directly to the inclined wedge surface 117 by the lower spring legs 91.

Also, the support plate 119 isolates the spring legs 91 from the sideward motion of the wedge 101. In particular, the side flanges 121 not only serve to mount the support plate 119 on the rod 40, but they also abut against the side walls 53 of the control housing 34 as seen in FIG. 15 so as to limit sideward movement thereof. Otherwise if the wedge 101 directly contacted the spring legs 91, the wedge block 101 would tend to urge the lower legs 91 not only upwardly but also sidewardly due to friction which could lead to undesirable distortion of the front spring 42.

As can be seen, the tension being applied by the front spring 42 is adjusted by manual rotation of the adjustment knob 47 and selective driving of the adjustment shaft 104 into and out of the control housing 34.

While the tension adjustment mechanism 46 acts on the lower spring legs 91 of the front spring 42, the skilled artisan will also appreciate that the tension adjustment mechanism 42 could be used to press the upper spring leg 94 downwardly to adjust the spring force. Further, the skilled artisan will appreciate that the tension adjustment mechanism 42 is usable on other types and arrangements of springs to adjust the spring forces being applied by the spring.

With respect to the rear springs 43, the springs 43 act in combination with the front spring 42 to urge the top plate 39 upwardly. Generally, each of the rear springs 42 includes an upper leg 126 which acts upwardly on the top plate 39, and a lower leg 127 which acts downwardly on the rear wall 54 of the control housing 34.

More particularly, the rear coil springs 43 are supported on the rear pivot rod 41 in substantially coaxial relation therewith by inner plastic spacers 128. The inner plastic spacers 128 are substantially cylindrical and have a bore therethrough so as to receive the rear pivot rod 41. Thus, as the back support member 36 pivots downwardly, some rotational movement of the rear springs 43 relative to the rear pivot rod 41 is permitted.

To bias the top plate 39 upwardly, the lower legs 127 of the springs 43 extend forwardly into the control housing 34 and act downwardly upon the rear housing wall 54. Preferably, the rear springs 43 are formed as mirror images of each other such that the lower legs 127 thereof are both spaced inwardly of the housing side walls 53. The lower legs 127 are supported on the rear wall 54 by a semi-cylindrical steel support pin 129 which is welded thereto. Preferably, the support pin 129 has a semi-circular shape and includes two peripheral grooves 130 near the opposite ends thereof which positively retain the lower spring legs 127 therein. The peripheral grooves 130 define arcuate bearing surfaces 131 on which the lower spring legs 127 act.

Referring to FIGS. 15 and 16, the lower spring legs 127 extend generally forwardly and horizontally when the top plate 39 is in forward tilted or in the normal position illustrated in FIGS. 8 and 9. In either position, the lower spring legs 127 act downwardly onto the top of the arcuate bearing surface 131. As a result, substantially all of the spring forces of the rear coil springs 43 act upwardly on the top plate 39 since the lower legs 127 act in an opposite direction downwardly.

Figure 18:
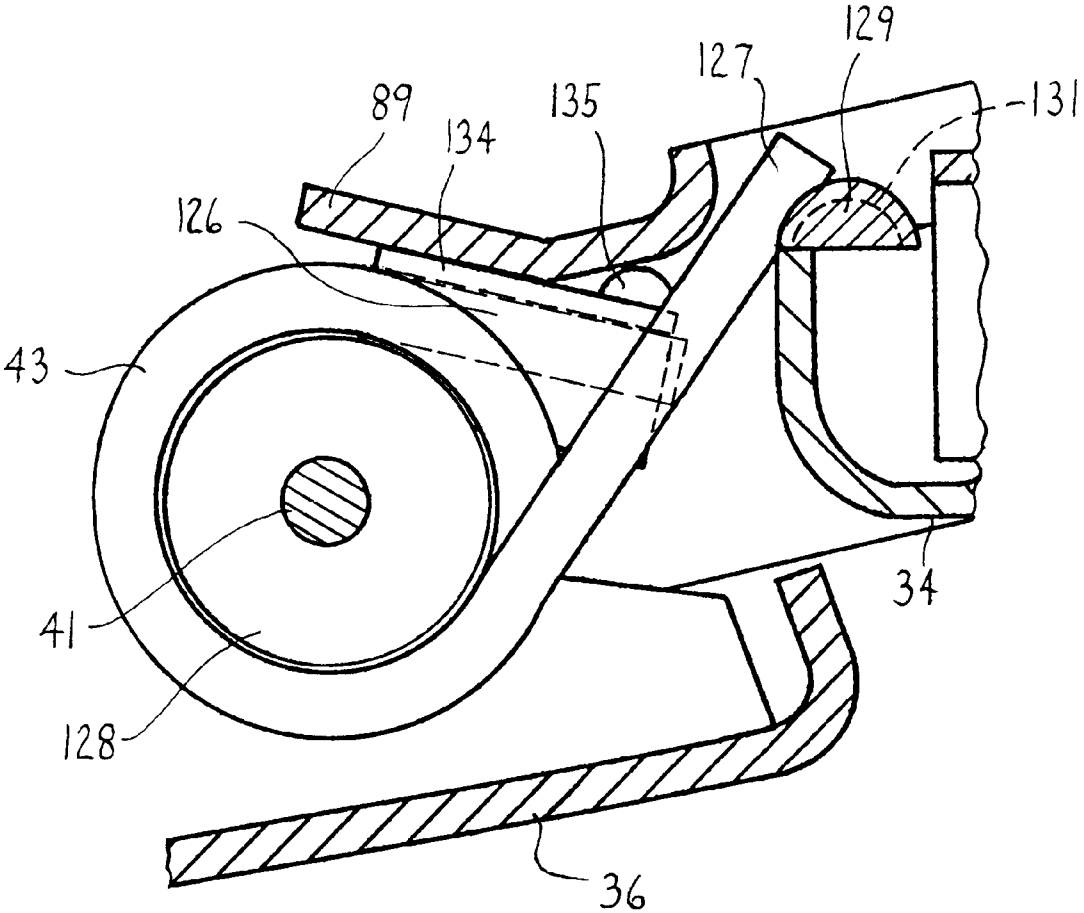
FIG. 18 is an enlarged partial side elevational view in cross section illustrating a rear spring in the rearwardly tilted position.

However, upon rearward tilting of the top plate 39 and back support member 36, the rear springs 43 which are joined to the back support member 36 move downwardly therewith such that the angle of the lower spring legs 127 changes significantly. In particular, as seen in FIG. 18, the lower spring legs 127 are steeply inclined so as to act generally on the side surfaces of the arcuate bearing surface 131 instead of the top thereof While the force of the lower spring legs 127 acting on the arcuate bearing surface 131 preferably has a vertical component which acts downwardly on the support pin 129, most of the spring forces act sidewardly or forwardly on the pin 129 with a horizontal force component. Thus, the magnitude of the forces acting upwardly on the top plate 39 is significantly less than would otherwise occur if the lower legs 127 acted solely with a vertical force component. This is desirable since the rear springs 43 still serve to urge the chair to its normal position. Further, the upward acting force on the chair is reduced when the seat and back assemblies 11 and 12 are pivoted rearwardly to the rear position illustrated in FIGS. 9 and 18 since the lower legs 127 also act with the horizontal force component. Thus, a user can tilt the chair to the rearwardly reclined position (FIG. 9) with significantly less tilting force than would otherwise be required to tilt the chair rearwardly. This reduction in force further optimizes the comfort of a user.

With respect to the upper spring legs 126, these legs 126 preferably extend below the top plate 39 so as to act upwardly. However, since some sliding or displacement of these upper spring legs 126 along the lower surface of the top plate 39 occurs during rearward tilting of the chair, an intermediate plastic bearing plate 134 is preferably provided to reduce the friction generated between the top plate 39 and the upper spring legs 126.

Preferably, the bearing plate 134 is formed as an extension of the plastic spacers 128. In particular, the bearing plate 134 is cantilevered from an outer end of the plastic spacers 128 and projects forwardly and below the top plate 39 so as to be in contact with the inclined flange 89. Preferably, the free end of the bearing plate 134 also includes a rounded rib 135 projecting upwardly therefrom which contacts the bottom of the top plate 39. The rib 135 is preferred since it reduces the amount of surface area of the bearing plate 134 which is in contact with the top plate 39.

As a result of the spring arrangement disclosed herein, the upward acting forces on the top plate 39 can be varied during use. In particular, the forces being applied by the front spring 42 are continuous during use but can be adjusted by the tension adjustment mechanism 46. The rear springs 43, however, which assist the front spring 42 not only provide a spring force which acts upwardly on the top plate 39, but also serve to vary the overall spring force acting on the top plate 39. In particular, the spring force provided by the rear springs 43 is reduced when the top plate 39 is raised to its forwardmost position since the deflection of the rear springs 43 is reduced. However, as the back support member 36 tilts downwardly, the lower legs 127 are significantly inclined. As a result, while the actual forces applied by the rear springs 43 increase, the forces applied by the lower legs 127 act with both the horizontal and vertical force components such that the vertical force urging the top plate 39 upwardly is less than would otherwise occur. The arrangement of the rear springs 43 and the support pin 129 serves to reduce the effective spring rate of the rear springs 43 as the chair is reclined. This reduction in spring force allows a user to maintain the chair 10 in the fully reclined position with significantly less force than was required to tilt the chair rearwardly.

By separating the forces being applied to the top plate 39 through the use of both the front spring 42 and the rear springs 43, the overall height or profile of the tilt control mechanism 14 is reduced.

With the foregoing structure, the seat and back assemblies 11 and 12 tilt both forwardly and rearwardly. However, it is also desirable to be able to lock out either the forward tilting or the backward tilting or both. Thus, the tilt control mechanism 14 also includes a front locking arrangement and a rear locking arrangement.

The front locking arrangement includes the aforementioned front tilt lock block 82 (FIGS. 10 and 13) which is slidably engaged with the top plate 39.

In particular, the front block 82 includes upstanding pins 139 which are inserted from below into the wide end of the slots 81 formed at the front of the top plate 39. The pins 139 have a reduced diameter section which allows for sliding of the pins 139 along the reduced diameter portion of the slots 81. By sliding the front block 82 along the slots 81, the front block 82 is movable forwardly and rearwardly relative to the front housing wall 52. The forward and rearward movement of the front tilt lock plate 82 is effected by a front actuation mechanism (not illustrated) which is activated by rotation of a front locking knob 140 (FIGS. 1–4). The front locking knob 140 serves to rotate an elongate rod 138 (FIG. 4) which is supported by one of the arms 28 of the seat support frame 25. The inner end of this rod 138 includes a leg which pivots upon rotation of the front locking knob 140 and abuts against a lever (not illustrated) mounted on the control housing 34 that pivots about a vertical pivot axis. The lever (not illustrated) thereby acts against the rightward pin 139 of the front tilt lock plate 82 which is formed with a cylindrical bearing surface 141 so as to be movable forwardly and rearwardly along the angled slots 81. Thus, upon clockwise and counter-clockwise rotation of the front locking knob 140, the front tilt lock block 82 can be moved forwardly and rearwardly.

Referring to FIG. 11, the front tilt lock block 82 includes a thin portion 142 along the front edge thereof, and a thick portion 143 along a rear edge thereof. Locking out of forward tilting is accomplished by moving the thicker portion 143 of this front tilt lock block 82 into the space formed between the upper edge of the front wall 52 and a bottom surface of the top plate 39.

In particular, when the thin portion 142 is disposed in the gap formed between the housing front wall 52 and the top plate 39 as seen in FIG. 12, the top plate 39 is able to pivot forwardly about the front pivot axis P1 to the forwardly tilted position illustrated in FIG. 9. Upon rearward tilting of the top plate 39, however, the front edge thereof pivots upwardly away from the top edge of the housing front wall 52.

Thus, to lock out the forward tilting, the front tilt lock block 82 can be moved forwardly into this space such that the thick portion 143 is positioned between the housing front wall 52 and the top plate 39. This thick portion 143 thereby prevents forward tilting of the top plate 39 past the normal horizontal chair position illustrated in FIG. 8. Upon rearward movement of the front tilt lock plate 82 out of this space, forward tilting can then be resumed. However, even though forward tilting is locked out, rearward tilting is still permitted.

To also lock out the rearward tilting of the chair 10, the aforementioned rear tilt lock plate 85 is provided as seen in FIGS. 10 and 12. The rear tilt lock plate 85 includes rearwardly extending flanges 146 along the top edge thereof which are adapted to be slid from below into the corresponding slots 84 (FIG. 14) formed in the top plate 39. The rear tilt lock plate 85 thus is pivotally connected to the top plate 39 so as to be movable forwardly to the forwardmost position illustrated in FIG. 12 and rearwardly into an interfering relation with the mounting bracket 35 located in the control housing 34.

More particularly, when the rear tilt lock plate 85 is disposed in the forwardmost position illustrated in phantom outline in FIG. 17, rearward tilting of the seat and back assemblies 11 and 12 is permitted. However, the rear tilt lock plate 85 can be rearwardly swung into an interfering relation with the mounting bracket 35 to lock out rearward tilting when the chair is either in the forwardmost position (FIG. 9), or the normal horizontal position (FIG. 8).

To lock the chair in the forward tilted position (FIGS. 9 and 10), the bottom edge of the rear tilt lock plate 85 includes a central tab 147 which projects downwardly therefrom This tab is adapted to be slidably received into a corresponding notch 148 formed in the front edge of the mounting bracket 35. When the central tab 147 seats in this notch 148 as seen in FIG. 17, the lower edge of the rear tilt lock plate 85 is seated on the top surface of the mounting bracket 35. The rear tilt lock plate 85 thereby acts as a brace which extends upwardly from the mounting bracket to the bottom surface of the top plate 39 which prevents rearward tilting of the top plate 39.

Figure 19:
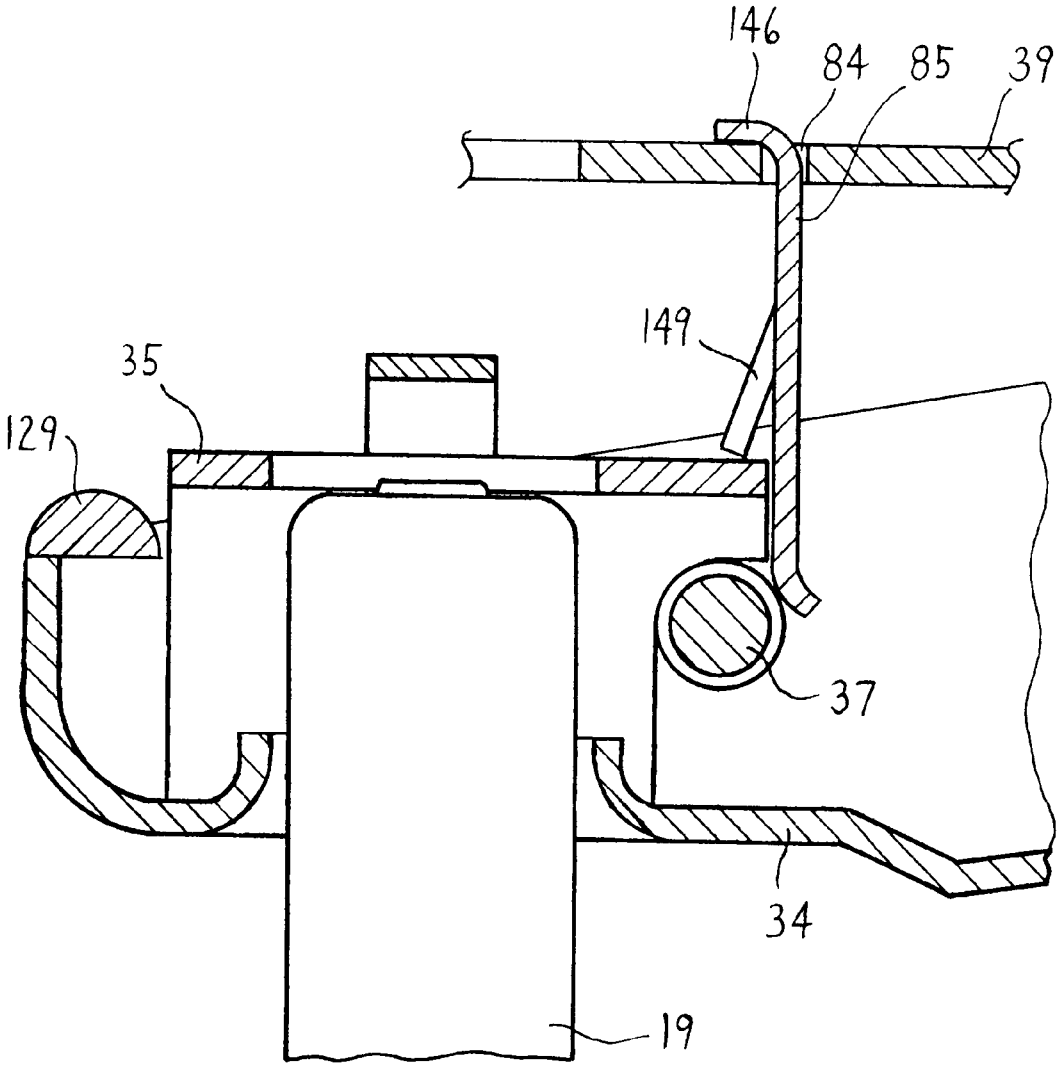
FIG. 19 is an enlarged partial side elevational view in cross section illustrating a rearward tilt lock in a locked position.

The rear tilt lock plate 85 also is usable to lock out rearward tilting of the chair 10 from the normal horizontal position while still permitting forward tilting thereof In particular, the rear tilt lock plate 85 also includes a pair of tabs 151 (FIGS. 10 and 19) which project rearwardly and downwardly from the plate 85. To lock out rearward tilting, the rear tilt lock plate 85 is tilted rearwardly until the lower edge thereof abuts against the front edge of the mounting bracket 35. When the rear tilt lock plate 85 is in this position, the rearwardly projecting tabs 149 are disposed directly above the front edge of the mounting bracket 35 and act as a stop upon rearward tilting of the top plate 39. While forward tilting is permitted, rearward tilting of the top plate 39 causes the tabs 149 to move downwardly until they contact the top surface of the mounting bracket 35 and thereby limit or stop further rearward tilting.

The forward and rearward swinging of the rear tilt lock plate 85 is provided by a rear tilt lock actuation mechanism (not illustrated) The rear tilt lock actuation mechanism is controlled by a rear locking knob 151 (FIGS. 1–3) which is rotated clockwise and counter-clockwise to rotate an elongate rod 152 which is mounted on the rear support arm 28 of the seat support frame 25. This rod 152 causes movement of the lock plate 85.

In view of the foregoing, the tilt control mechanism 14 is tiltable both forwardly and rearwardly. Further, this forward and rearward tilting can be locked out by a user.

Figure 20:
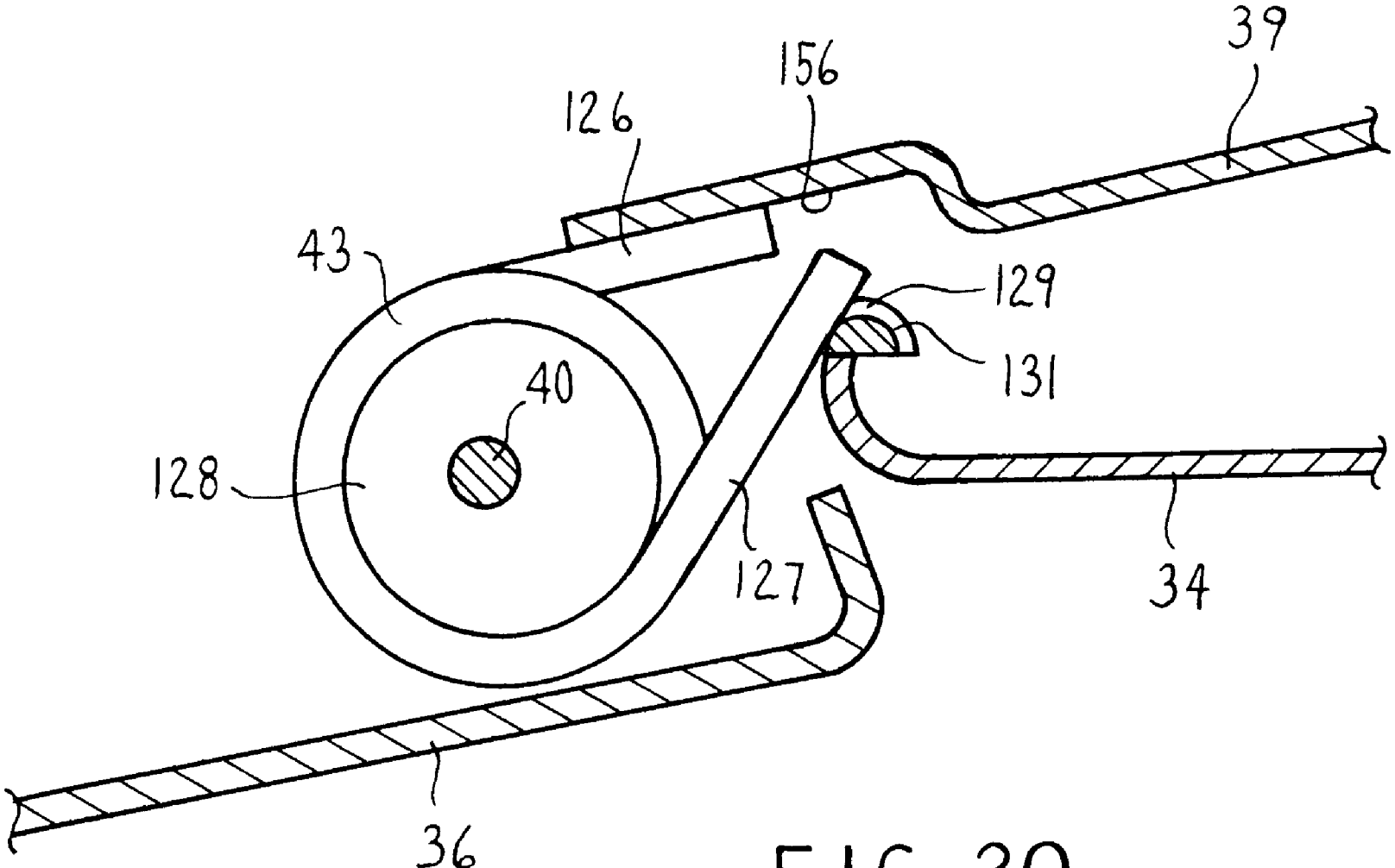
FIG. 20 is an enlarged partial side elevational view in cross section illustrating a rear spring of a second embodiment of the invention in the rearwardly tilted position.

In a further embodiment illustrated in FIG. 20, the plastic spacers 128 may be eliminated while the upper spring legs 126 are received in a downward opening pocket 156. The pocket 156 is formed in the top plate 39 and slidably receives the upper spring legs 126 therein. The pocket 156 therefore guides the spring leg 126 during movement of the back support member 36.

Alternatively, the pocket 156 also can be formed as a separate bracket which is fastened to the top surface of the top plate 39. In particular, the pocket 156 can be formed as a downward-opening U-shaped bracket which is bolted onto the top plate 39 and traps the upper spring leg 126 therein. In this arrangement, the inclined flange 123 is eliminated and the spring legs 126 extend over the top of the top plate 39.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chair having a base, a seat assembly and a tilt control mechanism which is supported on said base and permits rearward tilting of said seat assembly in response to a user, said tilt control mechanism including a fixed body supported on said base and a pivot member which pivots downwardly relative to said fixed body about a sidewardly extending horizontal pivot axis in response to said rearward tilting of said seat assembly, said tilt control mechanism further including a spring having a first leg portion acting on said fixed body and a second leg portion acting on said pivot member such that said spring defines a spring force acting on said pivot member, said second leg portion being resiliently deflectable relative to said first leg portion so as to act against but permit pivoting of said pivot member about said pivot axis and bias said pivot member to counteract said rearward tilting of said seat assembly, the improvement comprising an adjustment mechanism for adjusting a deflection of said first leg portion relative to said second leg portion, said adjustment mechanism including a tension adjustment member which is movable sidewardly relative to said fixed body, and a wedge which is slidable toward and away from said spring in an axial direction transverse to sideward movement of said adjustment member, said wedge having an inclined surface which faces toward said spring, and one of said first and second leg portions being slidable axially along said inclined surface as said wedge is moved axially to effect vertical movement of said one of said first and second leg portions, said adjustment mechanism further including connector means for transferring said sideward movement of said adjustment member into axial movement of said wedge to move said one of said first and second leg portions vertically to vary the spring force.

2. A chair according to claim 1, wherein said first leg portion acts downwardly on a bottom surface of said fixed body, and said second leg portion acts upwardly on said pivot member.

3. A chair according to claim 1, wherein said connector means comprises an angled guide, said wedge being movable sidewardly and axially along said guide in response to sideward movement of said adjustment member.

4. In a chair having a base, a seat assembly and a tilt control mechanism which is supported on said base and permits rearward tilting of said seat assembly in response to a user, said tilt control mechanism including a fixed body supported on said base and a pivot member which pivots downwardly relative to said fixed body about a sidewardly extending horizontal pivot axis in response to rearward tilting of said seat assembly, said tilt control mechanism further including a spring having a first leg portion acting on said fixed body and a second leg portion acting on said pivot member such that said spring defines a spring force acting on said pivot member, said second leg portion being resiliently deflectable relative to said first leg portion so as to act against but permit pivoting of said pivot member about said pivot axis and bias said pivot member to counteract rearward tilting of said seat assembly, the improvement comprising an adjustment mechanism to adjust a deflection of said first leg portion relative to said second leg portion, said adjustment mechanism including a tension adjustment member which is movable sidewardly relative to said fixed body, and a wedge which is slidable toward and away from said spring in an axial direction transverse to sideward movement of said adjustment member, said adjustment mechanism further including connector means for transferring sideward movement of said adjustment member into said axial movement of said wedge to move one of said first and second leg portions vertically to vary the spring force, said connector means comprising an elongate track which projects upwardly from said fixed body and is oriented at an angle relative to said pivot axis, said wedge including an elongate channel which opens from a bottom surface thereof and slidably receives said track therein, said wedge being slidable along said track so as to have both an axial component of motion and a sideward component of motion.

5. A chair according to claim 4, wherein said adjustment member is threadingly engaged with said fixed body such that rotation of said adjustment member effects sideward movement thereof, said adjustment member acting against a side surface of said wedge and being movable toward said wedge so as to effect angled sliding of said wedge along said track toward said spring.

6. A chair according to claim 5, wherein said wedge includes an inclined surface facing toward said spring, said one of said first and second leg portions being slidable axially along said inclined surface as said wedge is moved axially to effect vertical movement of said one of said first and second leg portions.

7. In a chair having a base, a seat assembly and a tilt control mechanism which is supported on said base and permits rearward tilting of said seat assembly in response to a user, said tilt control mechanism including a fixed body supported on said base and a pivot member which pivots downwardly relative to said fixed body about a sidewardly extending horizontal pivot axis in response to rearward tilting of said seat assembly, said tilt control mechanism further including a spring having a first leg portion acting on said fixed body and a second leg portion acting on said pivot member such that said spring defines a spring force acting on said pivot member, said second leg portion being resiliently deflectable relative to said first leg portion so as to act against but permit pivoting of said pivot member about said pivot axis and bias said pivot member to counteract rearward tilting of said seat assembly, the improvement comprising an adjustment mechanism to adjust a deflection of said first leg portion relative to said second leg portion, said adjustment mechanism including a tension adjustment member which is movable sidewardly relative to said fixed body, and a wedge which is slidable toward and away from said spring in an axial direction transverse to sideward movement of said adjustment member, said adjustment mechanism further including a guide member which extends at an angle and cooperates with said wedge, said wedge being movable along said guide member with both axial and sideward components of motion such that sideward movement of said adjustment member effects axial movement of said wedge to move one of said first and second leg portions vertically and vary the spring force, a plate being positioned between an inclined surface of said wedge and said one of said first and second leg portions being moved by said wedge, said plate including a mounting section movably mounting said plate on said fixed body so as to be movable vertically by said wedge to effect a corresponding vertical movement of said one of said first and second leg portions, said mounting section limiting sideward movement of said plate to thereby prevent sideward movement of said one of said first and second leg portions in response to said sideward component of motion of said wedge.

8. In a chair having a base, a seat assembly and a tilt control mechanism which is supported on said base and effects rearward tilting of said seat assembly in response to a user, said tilt control mechanism including a fixed body supported on said base and a pivot member which pivots downwardly relative to said fixed body about a sidewardly extending horizontal first pivot axis in response to said rearward tilting of said seat assembly, said tilt control mechanism further including a spring having a first leg portion acting on said fixed body and a second leg portion acting on said pivot member to define a vertical spring force acting vertically therebetween, said second leg portion being resiliently deflectable relative to said first leg portion so as to act against but permit pivoting of said pivot member about said first pivot axis and bias said pivot member to counteract said rearward tilting of said seat assembly, comprising the improvement wherein said fixed body defines a bearing surface which supports said first leg portion, an end of said first leg portion acting downwardly on a top surface portion of the bearing surface, said spring being movable downwardly with said pivot member such that said first leg portion is deflected to vary said spring force acting on the pivot member, said first leg portion being increasingly inclined during rearward tilting so as to act axially and downwardly on said bearing surface with horizontal and vertical force components wherein said vertical force component initially increases and then decreases as said first leg portion is inclined.

9. A chair according to claim 8 wherein said bearing surface is supported on a rearward end of said fixed body, said spring being movable downwardly so that said first leg portion extends axially and upwardly toward said bearing surface into contact with a side thereof.

10. A chair according to claim 8, wherein said tilt control mechanism includes a back support member which has a forward end pivotally connected to said fixed body and a rearward end which supports a back assembly a rearward end of said pivot member being pivotally connected to said back support member rearwardly of said first pivot axis such that said back support member moves downwardly in combination with said pivot member, said spring being supported on said back support member so as to move vertically therewith.

11. A chair according to claim 9, which includes a second spring having a first leg portion acting on said fixed body and a second leg portion acting on said pivot member, said second leg portion being resiliently deflectable relative to said first leg portion so as to act against but permit pivoting of said pivot member about said first pivot axis and bias said pivot member to counteract said rearward tilting of said seat assembly, said second spring providing a substantially continuous spring force which acts on said pivot member during pivoting thereof.

12. A chair according to claim 11, which includes adjustment means for adjusting said spring force being provided by said second spring.

13. A chair according to claim 12, wherein said adjustment means comprises a wedge which is slidable in an axial direction toward and away from one of said first and second leg portions of said second spring, and actuation means for moving said wedge in said axial direction toward said spring to deflect one of said first and second leg portions thereof relative to the other of said first and second leg portions to adjust the spring force provided thereby.

14. A chair according to claim 6, wherein said bearing surface is arcuate.

15. A chair comprising:

a seat assembly for supporting a seat of a user;

a back assembly for supporting a back of a user;

a base; and a tilt control mechanism which is supported on said base and effects rearward tilting of said seat and back assemblies in response to a user, said tilt control mechanism including a fixed body supported on said base, a back support member which projects rearwardly away from said fixed body and includes a forward end pivotally connected to said fixed body such that said back support member pivots vertically about a first horizontal pivot axis, and a top plate overlying said fixed body which includes a front portion which is pivotally connected to said fixed body so as to pivot vertically about a second horizontal pivot axis and a rear portion which is connected to said back support member such that said top plate and said back support member pivot vertically together in response to said rearward tilting of said seat and back assemblies, said seat assembly being supported on said top plate and said back assembly being supported on said back support member, said tilt control mechanism further including a front spring and a rear spring biasing said top plate upwardly, said front spring having a first leg acting on said fixed body and a second leg acting upwardly on said top plate, said first and second legs of said front spring being resiliently deflectable relative to each other such that said second leg acts against but permits pivoting of said top plate about said second pivot axis and biases said top plate to counteract said rearward tilting of said seat and back assemblies, said rear spring being supported on said back support member so as to move vertically therewith and including a lower first leg acting downwardly on a rear portion of said fixed body and an upper second leg acting upwardly on said top plate, said first and second legs of said rear spring being resiliently deflectable relative to each other so as to act against but permit pivoting of said pivot member about said first pivot axis and bias said pivot member to counteract said rearward tilting of said seat and back assemblies, said rear portion of said fixed body including an upward facing arcuate bearing surface which supports an end of said lower leg of said rear spring thereon, said lower leg extending forwardly so as to act on a top surface portion of the bearing surface to act with a vertical force component, said lower leg extending upwardly as said rear spring is moved vertically downwards by said back support member such that said lower leg acts on a side of said bearing surface with both horizontal and vertical force components.

16. A chair according to claim 15, wherein said tilt control mechanism includes adjustment means for adjusting said spring force provided by said front spring, said spring force being applied by said front spring acting substantially continuously during downward pivoting of said top plate.

17. A chair according to claim 16, wherein one of said first and second spring legs of said front spring is deflected vertically by said adjustment means so as to increase and decrease said spring force.

18. A chair according to claim 15, wherein a plastic spacer is provided between said upper leg of said rear spring and a downward facing surface of said top plate so as to reduce friction therebetween.

19. A chair according to claim 18, wherein said front and rear springs are coil springs, said rear spring being supported on said back support member by a cylindrical body inserted in a hollow interior of said rear spring, said elastic member being formed integrally with said cylindrical body and projecting forwardly therefrom.

20. In a chair having a base, a seat assembly and a tilt control mechanism which is supported on said base and permits rearward tilting of said seat assembly, said tilt control mechanism including first and second members wherein one of said first and second members is connected to said base and the other of said first and second members is connected to said seat assembly such that said first and second members are movable relative to each other during rearward tilting of said seat assembly, said tilt control mechanism further including a resilient member having first and second biasing portions which are resiliently movable and act on said first and second members respectively to define a biasing force which resists rearward tilting, comprising the improvement wherein said tilt control mechanism includes an adjustment mechanism which moves said first biasing portion relative to said second biasing portion to adjust said biasing force, said adjustment mechanism including a wedge which is supported on said first member and is slidable toward and away from said resilient member in an axial direction, said adjustment mechanism further including an angled guide surface defined on said first member which extends at an angle relative to said axial direction, said wedge being movable along said guide surface sidewardly and axially, said adjustment mechanism further including an adjustment member which acts on said wedge, said wedge cooperating with said first biasing portion of said resilient member and said wedge being movable sidewardly and axially along said guide surface in response to sideward movement of said adjustment member to adjust said biasing force.

21. A chair according to claim 20, wherein said adjustment mechanism includes an angled flange on said first member which defines said guide surface, said wedge having an angled side surface which is disposed in opposing relation with said guide surface and is slidable therealong.

22. A chair according to claim 21, wherein said wedge includes an angled groove in which said flange is received, said angled side surface defining one side of said groove.

23. A chair according to claim 20, wherein said adjustment member is supported by said first member such that axial movement of said adjustment member is prevented, said wedge being movable axially relative to said adjustment member.

24. A chair according to claim 20, wherein said adjustment mechanism includes a plate between said resilient member and an inclined surface of said wedge, a first side of said plate being in contact with said first biasing portion and an opposite second side of said plate being disposed in slidable contact with said inclined surface, said inclined surface being sidewardly and axially slidable along said second side.

25. A chair according to claim 24, wherein said resilient member is a coil spring having a first leg which defines said first biasing portion and a second leg which defines said second biasing portion.

* * * * *

UNITED STATES PATENT AND TRADEMARK OFFICE

CERTIFICATE OF CORRECTION

PATENT NO. : 5 909 924

DATED : June 8, 1999

INVENTOR(S) : Richard N. Roslund, Jr.

It is certified that error appears in the above-identified patent and that said Letters Patent is hereby corrected as shown below:

Column 18, line 22; after "claim 8" insert
---,---.

Column 18, line 30; after "assembly" insert
---,---.

Column 18, line 37; change "claim 9" to
---claim 8---.

Signed and Sealed this

Seventh Day of December, 1999

*Attest:*

Q. TODD DICKINSON

*Attesting Officer*

*Acting Commissioner of Patents and Trademarks*